United States Patent [19]

Takesako

[11] Patent Number: 4,830,742

[45] Date of Patent: May 16, 1989

[54] APPARATUS FOR SORTING SHEETS

[75] Inventor: Sumiyoshi Takesako, Yamato, Japan

[73] Assignee: Tokyo Shibaura Denki Kabushiki Kaisha, Kawasaki, Japan

[21] Appl. No.: 139,143

[22] Filed: Dec. 24, 1987

Related U.S. Application Data

[63] Continuation of Ser. No. 887,978, Jul. 25, 1986, abandoned, which is a continuation of Ser. No. 596,147, Apr. 2, 1984, abandoned.

[30] Foreign Application Priority Data

Apr. 4, 1983 [JP] Japan ..... 58-59001

[51] Int. Cl.[4] ..... B07C 5/34

[52] U.S. Cl. ..... 209/534; 209/551; 235/379; 377/8; 902/17

[58] Field of Search ..... 209/534, 548, 549, 546, 209/551; 235/379; 377/6, 8; 902/8, 17

[56] References Cited

U.S. PATENT DOCUMENTS

| | | | |
|---|---|---|---|
| 3,759,382 | 9/1973 | Walkley et al. | 209/534 |
| 3,932,272 | 1/1976 | Carnes, Jr. et al. | 209/551 |
| 4,166,030 | 8/1979 | Lewis et al. | 209/551 |
| 4,365,700 | 12/1982 | Arimoto et al. | 235/379 |
| 4,402,410 | 9/1983 | Ohba et al. | 209/534 |
| 4,458,816 | 7/1984 | Hirose et al. | 209/534 |
| 4,465,192 | 8/1984 | Ohba et al. | 209/534 |
| 4,514,856 | 4/1985 | Asai et al. | 377/8 |
| 4,521,102 | 6/1985 | Motomura et al. | 377/8 |
| 4,653,647 | 3/1987 | Hashimoto | 209/534 |

FOREIGN PATENT DOCUMENTS

| | | | |
|---|---|---|---|
| 3201956 | 10/1982 | Fed. Rep. of Germany . | |
| 1532019 | 11/1978 | United Kingdom | 209/534 |
| 1555432 | 11/1979 | United Kingdom . | |
| 2078685 | 1/1982 | United Kingdom | 209/534 |
| 2093809 | 9/1982 | United Kingdom | 209/534 |
| 2111956 | 7/1983 | United Kingdom . | |
| 2127792 | 4/1984 | United Kingdom . | |

*Primary Examiner*—Robert B. Reeves
*Assistant Examiner*—Donald T. Hajec
*Attorney, Agent, or Firm*—Cushman, Darby & Cushman

[57] ABSTRACT

An apparatus for sorting sheets is disclosed, which comprises a feeder for setting a mixture of different kinds of sheets, the set sheets being fed one by one for sorting, a judging circuit for judging the kind of sheet being transported through the body of the apparatus after having been fed from the feeder, and a sorting/stacking section for sorting and stacking sheets in specified quantities for specified kinds according to the result of judgement in the judging circuit. The apparatus has a plurality of sorting modes for different kinds of sorting and can specify specified quantities for each mode.

19 Claims, 17 Drawing Sheets

FIG. 5A

| | |
|---|---|
| ○ FIT<br>● $10 | AMOUNT (QUANTITY) |
| ○ UNFIT<br>● $5 | AMOUNT (QUANTITY) |
| ○ FACE-UP<br>● $2 | AMOUNT (QUANTITY) |
| ○ FACE-DOWN<br>● $1 | AMOUNT (QUANTITY) |
| TOTAL | TOTAL AMOUNT |

FIG. 5B

| | |
|---|---|
| ○ FIT<br>● $10 | AMOUNT (QUANTITY) |
| ○ UNFIT<br>○ $5 | AMOUNT (QUANTITY) |
| ○ FACE-UP<br>○ $2 | AMOUNT (QUANTITY) |
| ○ FACE-DOWN<br>○ $1 | AMOUNT (QUANTITY) |
| TOTAL | TOTAL AMOUNT |

FIG. 5C

| | |
|---|---|
| ○ FIT<br>● $10 | AMOUNT (QUANTITY) |
| ○ UNFIT<br>○ $5 | |
| ○ FACE-UP<br>● $2 | AMOUNT (QUANTITY) |
| ○ FACE-DOWN<br>○ $1 | |
| TOTAL | TOTAL AMOUNT OF $10 AND $2 BILLS |

APPARATUS FOR SORTING SHEETS

This is a continuation of application Ser. No. 887,978, filed July 25, 1986, now abandoned upon the filing hereof, which, in turn, was a continuation of Ser. No. 596,147, filed Apr. 2, 1984, now abandoned.

BACKGROUND OF THE INVENTION

This invention relates to an apparatus for sorting a mixture of different kinds of sheets for individual specified kinds in specified quantities.

The apparatus for sorting sheets includes a bill sorting apparatus for sorting and stacking bills for individual specified kinds or categories in specified quantities. Such apparatus can operate in a mode which is selected among a plurality of modes depending on selected kinds or categories of bills, i.e., denominations, facing up or down, and fit/unfit. Among the available modes, there is a count mode, which has the aim of merely counting bills, facing mode for sorting bills depending on whether they are face-up or face-down, and fit/unfit mode for sorting bills depending on whether they are fit or unfit. A bundle of bills is usually sorted by sequentially selecting a plurality of different modes. In the sorting operation, when a certain specified quantity of bills is stacked in a stacker, the operation is interrupted and the operator takes out the specified quantity of bills. The taken-out bills are bundled as a bundle of the specified quantity of bills. In the prior art apparatus of the type noted, however, only single specified quantity data storage area is provided for all the modes. Therefore, if a specified quantity is changed in a certain mode, the altered quantity is also regarded as the specified quantity for a subsequently selected different mode. To reset the altered quantity data to the initial value, the power source is once off, or the data is manually changed. The former process is not practical, while the latter process is cumbersome.

SUMMARY OF THE INVENTION

An object of the invention is to provide a sheet sorting apparatus of the type having a plurality of modes for sorting and stacking sheets for specified kinds in specified quantities in each mode, in which specified quantities can be set for each mode, thus simplifying the procedure of operating the apparatus.

The above object of the invention is attained by an apparatus for sorting sheets, which comprises an operating section for specifying a mode and quantity data for the specified mode, and a sorting/stacking section for sorting and stacking sheets in specified quantities for corresponding specified kinds according to the specified mode.

BRIEF DESCRIPTION OF THE DRAWINGS

FIGS. 5A through 5G are views showing display examples of the operation/display panel for different modes;

DETAILED DESCRIPTION OF THE PREFERRED EMBODIMENT

Figure 1:
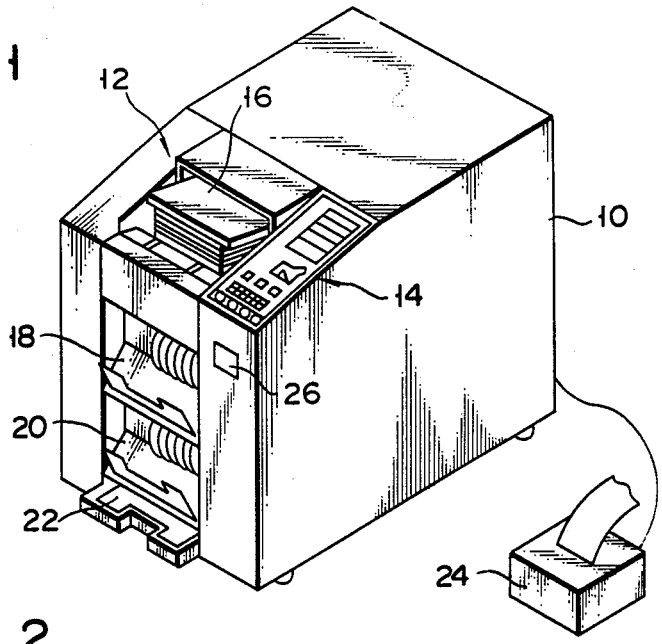
FIG. 1 is a perspective view showing an apparatus for sorting bills as an embodiment of the apparatus for sorting sheets according to the invention.

Now, an embodiment of the apparatus for sorting sheets according to the invention will be described with reference to the accompanying drawings. Referring to FIG. 1, an apparatus for sorting bills is shown in perspective as an embodiment of the invention. The apparatus has a body 10 which has a feeder 12 at the top. An operation/display panel 14 is provided adjacent to the feeder 12 for specifying various operation modes and also displaying the results of sorting. Up to 400 bills can be set horizontally in a stack in the feeder 12. The bills in the feeder 12 are fed one by one in a horizontal state at a rate of, for instance, 10 bills per second. At the feeder 12, a backup board 16 is provided which is capable of being automatically displaced in vertical directions to retain the bills set in the feeder 12. Bills are set in the feeder 12 with their leading long edge and left short edge aligned by a guide provided at the feeder 12. Since the bills have their leading edge aligned, they can be fed into the apparatus at a constant interval even if a mixture of bills of different sizes are stacked in the feeder 14, which is convenient for judging their category or denomination. The operation/display panel 12 has various operation keys and display elements described hereafter in detail. The bills fed from the feeder 12 are transported within the apparatus body 10, and during their transport their category or denomination is judged. According to the result of judgement, the bills are sorted and led to and stacked in corresponding upper, lower, or reject stacker 18, 20 or 22; these stackers being provided at the front of the body 10. The upper and lower stackers 18 and 20 each have a stack capacity of 200 bills which are horizontally stacked one above another, while the reject stacker 22 has a stack capacity of 100 bills. This embodiment of the apparatus is adapted such that when bills corresponding in quantity to the stack capacity or to a specified quantity less than the stack capacity are stacked in either stacker 18 or 20, the sorting operation is automatically interrupted so that the operator can take out and bundle the bills. A printer 24 is connected to the body 10 for printing the content displayed on the operation/display panel 14. Below the operation/display panel 14, a select switch 26 is provided which can set one of the fit/unfit levels 0 to 9, to be described later, used to discriminate fit and unfit bills.

Figure 2:
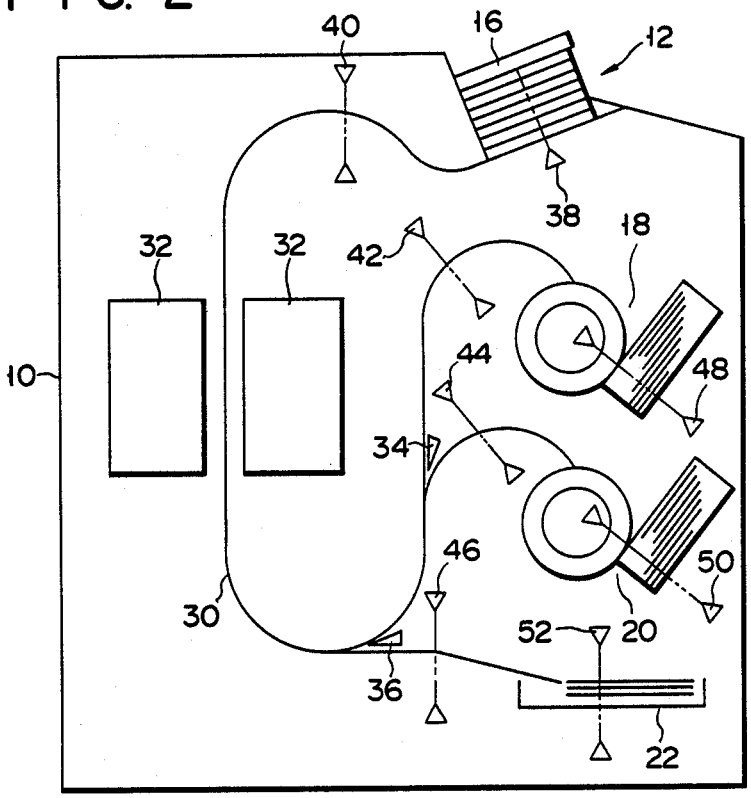
FIG. 2 is a schematic sectional view showing the internal construction of the apparatus.

FIG. 2 shows the internal construction of the apparatus. Bills fed from the feeder 12 are transported by a transporter 30 to the upper, lower, and reject stackers 18, 20, and 22. Although the transporter 30 is shown by a single solid line as the route of transport, actually it consists of a pair of transport belts, between which the bills are held while they are transported. A bill judging section 32 is provided on opposite sides of a portion of the route of the transporter 30 near the feeder 12. It serves to judge whether a bill transported through it is of a given denomination, whether the bill is a fit or unfit bill, and whether the bill is transported face-up or face-down. Branch transporters, branching from the main transporter 30, lead to the stackers 18, 20, and 22. Gates 34 and 36 with a flapper are provided at branching points of the two branch transporters. The flappers of the gates 34 and 36 are switched according to the judgement in the judging section 32.

A bill detector 38 is provided at the bottom of the feeder 12 to detect whether bills are stacked or not. A bill counter 40 is provided near the feeder 12, i.e., at an inlet end of the transporter 30, to count bills fed into the body 10. Bill counters 42, 44, and 46 are also provided near the inlet of the branch transporters to count bills led to and stacked in the corresponding stackers 18, 20, and 22. Bill detectors 48, 50, and 52 are also provided at the bottom of the respective stackers 18, 20, and 22 to detect whether bills are stacked or not.

As mentioned earlier, bills are transported in a horizontal state at a constant interval with one short side aligned. The bills are thus judged at an aligned lateral position in the judging section 32, thus resulting in less erroneous judgement. The judging section 32 judges bills according to light permeability thereof.

Figure 3:
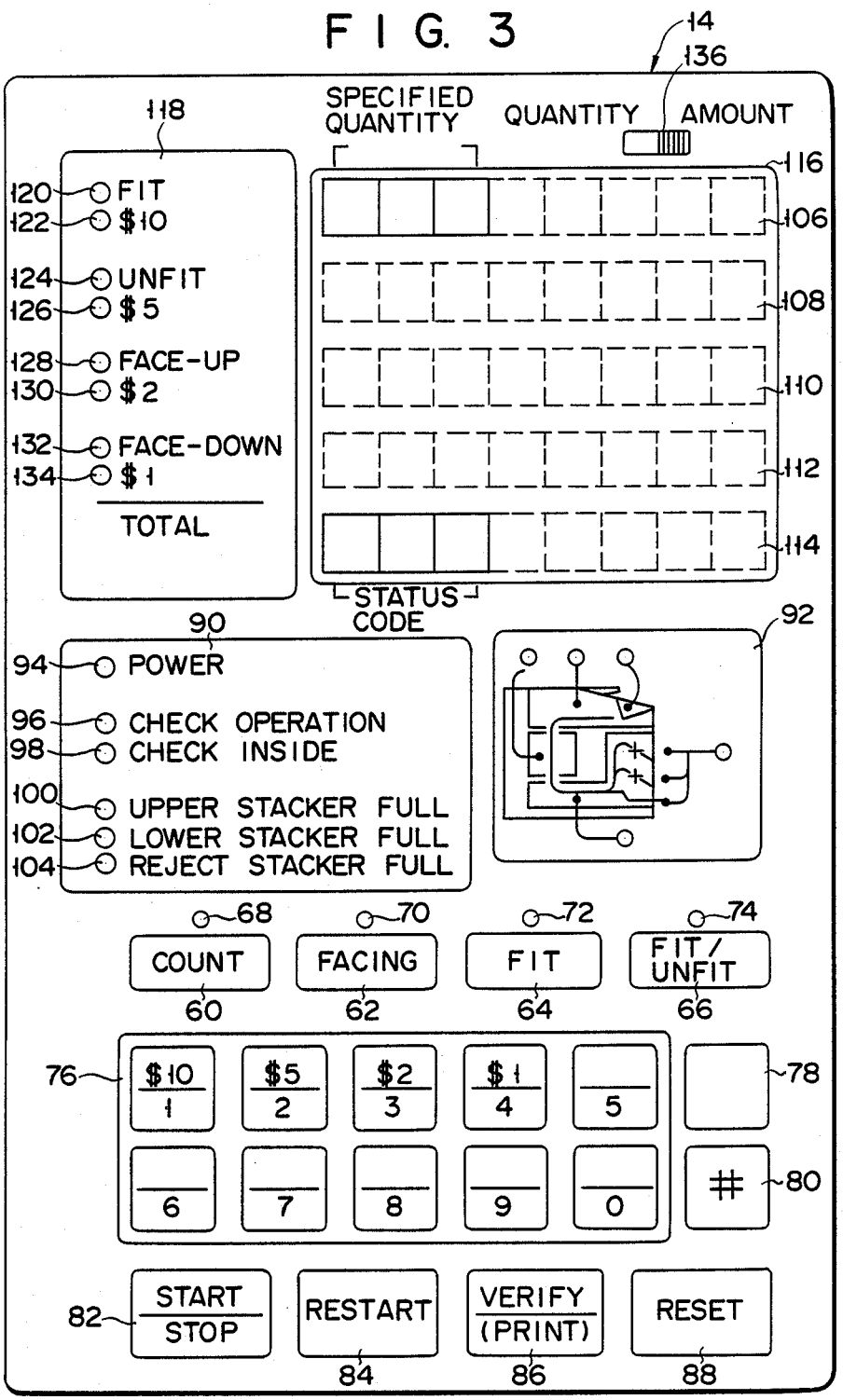
FIG. 3 is a plan view showing an operation/display panel.

FIG. 3 shows a plan view of the operation/display panel 14. This sorting apparatus basically has four different operating modes, as will be later described in detail. A count key 60, a facing key 62, a fit key 64, and a fit/unfit key 66 are provided at the center of the panel for specifying the corresponding modes. LEDs 68, 70, 72 and 74 are provided above the respective keys 60, 62, 64 and 66 to indicate the state thereof. Numeral keys 76 for specifying the quantity of bills to be stacked in the stackers 18 and 20, a blank key 78 to be used when inputting an account number or a transaction number, and a sharp key 80 are provided below the mode specification keys 60, 62, 64, and 66. Some of the numeral keys 76 also serve as keys for specifying denomination. The distinction between a numeral and denomination specification is determined at the time when the key is depressed. Below the keys 76, 78, and 40 are provided a start/stop key 82, a restart key 84, a verify/(print) key 86, and a reset key 88.

The keys noted above are arranged from top to bottom in the order in which they are operated when the apparatus is normally operated, which is desired from the standpoint of operability.

An appartus state display section 90 and an error display section 92 are provided above the mode specification keys 60, 62, 64, and 66. The apparatus state display section 90 includes a power lamp 94, a check operation lamp 96, a check inside lamp 96, and upper, lower and reject stacker full lamps 100, 102, and 104. The error display section 92 includes a film with a pattern impression of a schematic sectional view of the essential part of the apparatus and the lamps which are driven when a fault, such as jamming, occurs at the pertinent locality.

A numeric display section 116 having five display rows 106, 108, 110, 112, and 114 is provided above the apparatus state display section 90 and error display section 92. The first to fourth display rows 106, 108, 110, and 112 are provided for displaying the quantity or amount of bills of the corresponding category. The fifth row 114 is provided for displaying the sum of the quantities or amounts displayed on the first to fourth rows 106, 108, 110, and 112. A title display section 118 is provided on the left side of the numeric display section 116. It serves to indicate the category of the data which is displayed on each row in the numeric display section 116. It includes a fit lamp 120 and a $10 lamp for the first row 106, an unfit lamp 124 and a $5 lamp 126 for the second row 108, a face-up lamp 128 and a $2 lamp 130 for the third row 110, and a face-down lamp 132 and a $1 lamp 134 for the fourth row 112. A title impression "TOTAL" is provided for the fifth row 114. The denomination lamps and category lamps provide different colors, so they can be readily distinguished from one another. A quantity/amount switch 136 is provided above the numeric display section 116. It is switched to indicate that the data displayed on the display rows represents the quantity or amount of bills. The three left digits in the first display row 106 are used to indicate a specified quantity of bills to be stacked in the stackers 18 and 20. The left three digits in the fifth display row 114 are used to indicate a status code representing a faulty status when such status occurs. Numerical data input from the numerical keys 76 is shifted from the right end digit in the fifth display row 114 to the left.

It is to be noted that the numeric display section 116 is capable of two displays, so that it can be realized in a small size compared to the case where there is only a single display.

Figure 4:
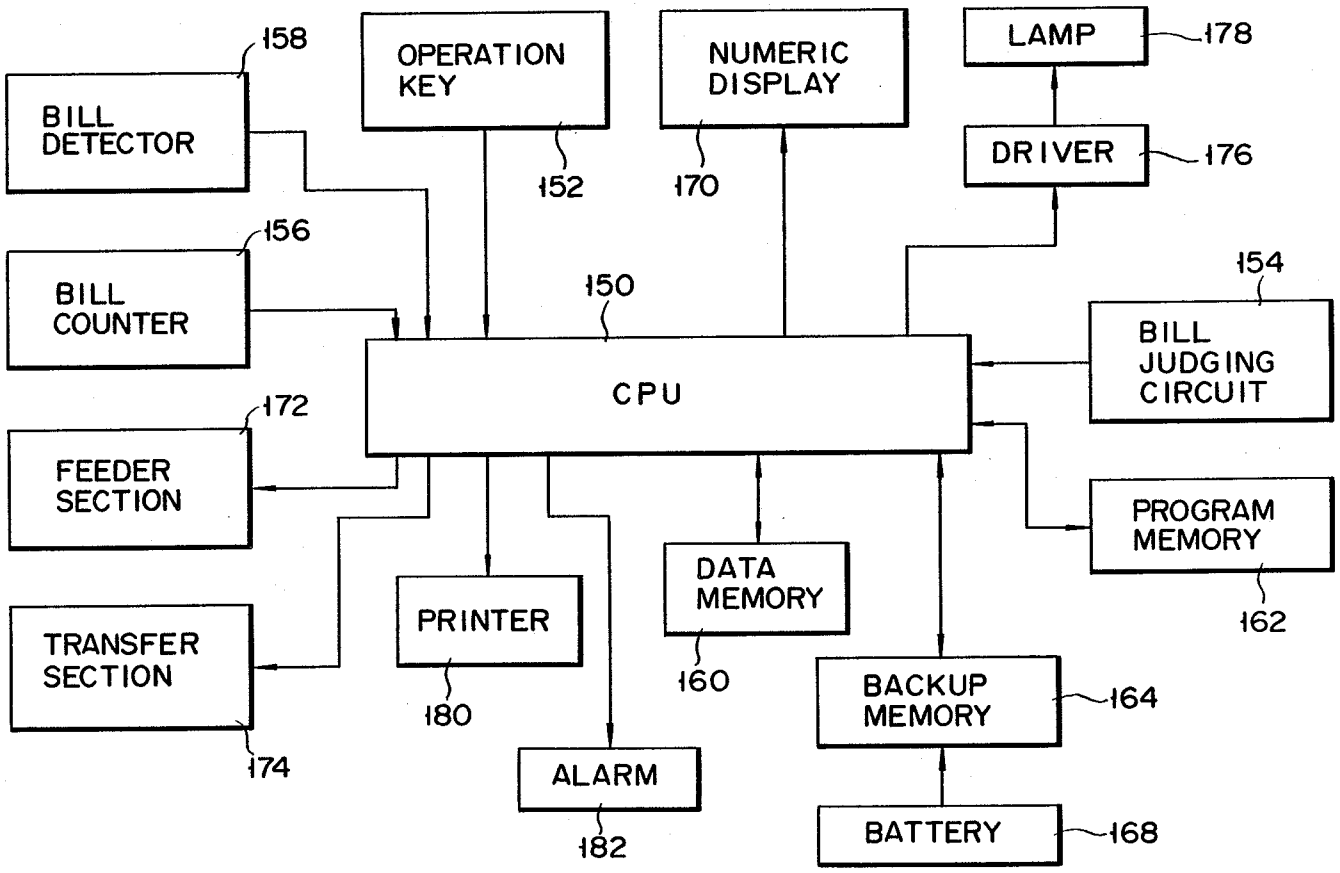
FIG. 4 is a block diagram showing a control circuit of the apparatus.

FIG. 4 is a block diagram showing a control circuit for controlling the entire apparatus of this embodiment. Various controls are mostly executed by a CPU 150. Outputs of operaton key 152 (corresponding to the keys 60, 62, 64, 66, 76, 78, 80, 82, 84, 86, and 88 shown in FIG. 3), bill judging circuit 154 (corresponding to the bill judging section 32 shown in FIG. 2), bill counter 156 (correspnding to the bill counters 40, 42, and 44 shown in FIG. 2), and bill detector 158 (corresponding to the bill detectors 38, 48, 50, and 52 shown in FIG. 2) are supplied to the CPU 150. Data memory 160, program memory 162, and backup memory 164 are also coupled to the CPU 150. Various controls are executed according to programs stored in the program memory 162. A battery 168 is connected to the backup memory 164. The CPU 150 provides control signals to numeric display 170 (corresponding to the numeric display section 116 shown in FIG. 3), feeder section 172 (corresponding to the feeder 12 shown in FIG. 1), transfer section 174 (corresponding to the transporter 30 and gates 34 and 36 shown in FIG. 2), driver 176 for driving a lamp 178 (corresponding to the lamps in the sections 90, 92, and 118 shown in FIG. 3), printer 180 (corresponding to the printer 24 shown in FIG. 1), and alarm 182. The alarm 182 is driven for a predetermined period of time in response to the occurrence of a fault.

The data memory 160 and backup memory 164 serve as means for storing various data, with their memory map being shown in Table 1 below.

TABLE 1

| | | |
|---|---|---|
| CCTR | CACTR | quantity CTR ($10) |
| | | quantity CTR ($5) |
| | | quantity CTR ($2) |
| | | quantity CTR ($1) |
| | | total quantity CTR |
| | | quantity CTR (fit) |
| | | quantity CTR (unfit) |
| | | quantity CTR (face-up) |
| | | quantity CTR (face-down) |
| | | total quantity CTR |
| | CBCTR | quantity CTR ($10) |

TABLE 1-continued

| | | |
|---|---|---|
| | | quantity CTR ($5) |
| | | quantity CTR ($2) |
| | | quantity CTR ($1) |
| | | total quantity CTR |
| | | quantity CTR (fit) |
| | | quantity CTR (unfit) |
| | | quantity CTR (face-up) |
| | | quantity CTR (face-down) |
| | | total quantity CTR |
| BCTR | BACTR | quantity CTR ($10) |
| | | quantity CTR ($5) |
| | | quantity CTR ($2) |
| | | quantity CTR ($1) |
| | | total quantity CTR |
| | | quantity CTR (fit) |
| | | quantity CTR (unfit) |
| | | quantity CTR (face-up) |
| | | quantity CTR (face-down) |
| | | total quantity CTR |
| | BBCTR | quantity CTR ($10) |
| | | quantity CTR ($5) |
| | | quantity CTR ($2) |
| | | quantity CTR ($1) |
| | | total quantity CTR |
| | | quantity CTR (fit) |
| | | quantity CTR (unfit) |
| | | quantity CTR (face-up) |
| | | quantity CTR (face-down) |
| | | total quantity CTR |
| DCTR | D1CTR | quantity CTR ($10) |
| | | quantity CTR ($5) |
| | | quantity CTR ($2) |
| | | quantity CTR ($1) |
| | | total quantity CTR |
| | D2CTR | amount CTR ($10) |
| | | amount CTR ($5) |
| | | amount CTR ($2) |
| | | amount CTR ($1) |
| | | total amount CIR |
| | D3CTR | quantity CTR (fit) |
| | | quantity CTR (unfit) |
| | | quantity CTR (face-up) |
| | | quantity CTR (face-down) |
| | | total quantity CTR |
| ACTR | A1CTR | quantity CTR ($10) |
| | | quantity CTR ($5) |
| | | quantity CTR ($2) |
| | | quantity CTR ($1) |
| | | total quantity |
| | A2CTR | amount CTR ($10) |
| | | amount CTR ($5) |
| | | amount CTR ($2) |
| | | amount CTR ($1) |
| | | total amount CTR |
| NCTR | quantity CTR (count) | |
| | quantity CTR (facing) | |
| | quantity CTR (fit) | |
| | quantity CTR (fit/unfit) | |
| PCTR | P0CTR (feeder) | |
| | P1CTR (upper stacker) | |
| | P2CTR (lower stacker) | |
| | P3CTR (reject stacker) | |
| OCTR | verify CTR | |
| | numeral flag | |
| | numeral buffer | |
| | start flag | |
| | code buffer | |
| | manual input buffer | |
| | mode flag. | |
| | denomination buffer | |

The memory area is broadly divided into memory units of CCTR (current counter), BCTR (backup counter), DCTR (display counter), ACTR (accumulation counter), NCTR (numerical counter), PCTR (pocket counter), and OCTR (operation counter) areas. The CCTR area stores data representing the quantity or amount of bills stacked in the upper and lower stackers 18 and 20. The BCTR area stores data representing the quantity or amount of sorted bills taken out from the upper and lower stackers 18 and 20. The DCTR area stores data representing the quantity or amount of sorted bills of each category for displaying. The ACTR area stores data representing the total of the quantities or amounts of sorted bills of each category. The NCTR area stores data representing a specified quantity of bills to be stacked in the upper and lower stackers 18 and 20. The PCTR area stores data representing the quantity of bills stacked in the stackers 18 and 20 separate from the CCTR area. The OCTR area stores data representing the key operation states of the operation/display panel 12.

The CCTR area includes a CACTR area for the upper stacker 18 and a CBCTR area for the lower stacker 20. The CACTR and CBCTR areas each consist of quantity CTRs for respective $10, $5, $2, and $1 bills, a total quantity CTR for all of the $10, $5, $2, and $1 bills, quantity CTRs for respective fit, unfit, face-up, and face-down bills, and a total quantity CTR for all of the fit, unfit, face-up, and face-down bills. Data are stored in the individual CTRs in response to output signals from the bill counters 42 and 44 provided at the inlet of the upper and lower stackers 18 and 20.

The BCTR area, like the CCTR area, includes a BACTR area and a BBCTR area for the respective upper and lower stackers 18 and 20. The BACTR and BBCTR areas each consist of the same CTRs as those in the CACTR and CBCTR areas. The data in the CCTR area is transferred to the BCTR area at the timings of appearance of output signals from the bill detectors 48 and 50 provided at the bottom of the upper and lower stackers 18 and 20. The data in the CCTR area is reset at this time.

The DCTR area includes a D1CTR, a D2CTR, and a D3CTR areas. The D1CTR area consists of quantity CTRs for respective $10, $5, $2, and $1 bills and a total quantity CTR for all of the $10, $5, $2, and $1 bills. The D2CTR area consists of amount CTRs for respective $10, $5, $2, and $1 bills and a total amount CTR for all of the $10, $5, $2, and $1 bills. The D3CTR consists of quantity CTRs for respective fit, unfit, face-up, and face-down bills and a total quantity CTR for all of the fit, unfit, face-up, and face-down bills. The sums of like data in the CTRs of the CCTR and BCTR areas are stored in the correspnding CTRs of the DlCTR and D2CTR area (DCTR→CCTR+BCTR).

The ACTR area includes A1CTR and A2CTR areas. The A1CTR area consists of quantity CTRs for respective $10, $5, $2, and $1 bills and a total quantity CTR for all of the $10, $5, $2, and $1 bills. The A2CTR area includes amount CTRs for respective $10, $5, $2, and $1 bills and a total amount CTR for all of the $10, $5, $2, and $1 bills. When stacked bills are taken out from the upper and lower stackers 18 and 20, the data in the individual CTRs of the CCTR area is accumulated to the data in the corresponding CTRs of the ACTR area (ACTR→ACTR+CCTR).

The NCTR area consists of four quantity CTRs for storing data representing specified quantity of bills stacked in the upper and lower stackers 18 and 20 in individual modes. The initial quantity is 200 bills for count and facing modes and 100 bills for fit and fit/unfit modes.

The PCTR area includes a P0CTR for storing data representing the quantity of bills fed from the feeder 12, and a P1CTR, a P2CTR, and a P3CTR for storing data representing the quantities of bills stacked in the respective stackers 18, 20, and 22.

The OCTR area is as shown in Table 1 above, and its detailed description is omitted.

The CCTR and BCTR areas have buffer areas for the individual CTRs.

Now, the operation of the embodiment will be described. In this embodiment, predetermined categories of bills are sorted in the individual stackers in the respective modes, as shown in Table 2.

TABLE 2

| | Mode | | | | | | |
|---|---|---|---|---|---|---|---|
| | Count (A) | | | Faceing (B) | | Fit (C) | Fit/unfit (D) |
| Denomination specification | No denomination specified (A-1) | One denomination specified (A-2) | Two denomination specified (A-3) | No denomination specified (B-1) | One denomination specified (B-2) | One denomination specified | One denomination specified |
| Preset specified quantity | 200 | 200 | 200 | 200 | 200 | 100 | 100 |
| Upper stacker 18 | Mixture (stacked to the lower stacker 20 after becoming full) | Specified denomination | First specified denomination | Mixture (face-up) | Specific denomination (face-up) | Fit specified denomination (face-up) | Fit specified denomination (face-up) |
| Lower stacker 20 | Mixture | Non-specified denominaion | Second specified denomination | Mixture (face-down) | Specified denomination (face-down) | Fit specified denomination (face-down) | Unfit specified denomination (face-up) |
| Reject stacker 22 | Reject | Reject | Non-specified denomination and reject | Reject | Non-specified denomination and reject | Unfit, non-specified denomination and reject | Specified denomination (face-down), non-specified denomination and reject |

In table 2, the term "reject" refers to bills which are incapable of judgement, e.g., counterfeit bills, greatly damaged bills, overlapped bills, broken bills, wrinkled bills, etc. The term ? unfit? refers to a bill which has been used so much that it is unfit for reuse and should be returned to the source of issuance (i.e., a central bank). The term ? fit? refers to a bill which is fit for reuse. In fit mode (C) and fit/unfit mode (D), a denominaton must be specified. The individual modes will now be briefly described.

In count mode (A-1) without any denomination specified, of the bills fed to the apparatus all bills except for reject bills are counted for individual denominations. Bills having been counted are stacked alternately in the upper and lower stackers 18 and 20 by specified quantities. In this mode, the display on the numeric display section 116 is as shown in FIG. 5A. Black dots indicate "on" lamps, and white dots indicate "off" lamps. Either the amount or quantity of $10, $5, $2, and $1 is displayed on the respective first to fourth display rows. The total amount is displayed on the fifth display row irrespective of the state of the quantity/amount switch 136.

In count mode (A-2) with one denomination specified, bills of the specified denomination are stacked in the upper stacker 18, the other denomination bills are stacked in the lower stacker 20, and reject bills are stacked in the reject stacker 22. Again in this mode, the bills are counted for the individual denominations. The display in this mode is as shown in FIG. 5B. The same kind of data as in the mode (A-1) is displayed. In this mode, however, only the lamp for the specified denomination (here $10 lamp) is turned on, unlike the case of the mode (A-1) in which all the denomination lamps are turned on.

In count mode (A-3) with two denominations specified, bills of a first denomination are stacked in the upper stacker 18, bills of a second denomination are stacked in the lower stacker 20, and the other denomination bills and reject bills are stacked in the reject stacker 22. Again in this case, the bills are counted for all the denominations, but only the amounts or quantities of bills of the two specified denominations (here $10 and $2) are displayed. As the total, the total amount of the $10 and $2 is displayed.

Figure 5D:
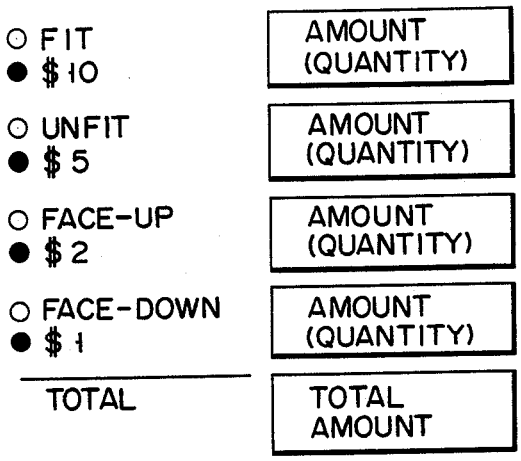

In facing mode without any denomination specified (B-1), face-up bills of all the denominations (i.e., mixture face-up bills) are stacked in the upper stacker 18, mixture face-down bills are stacked in the lower stacker 20, and reject bills are stacked in the reject stacker 22. The display in this mode is as shown in FIG. 5D, being entirely the same as in the case of the mode (A-1).

In the modes described so far, the total amount is displayed on the total display row irrespective of the state of the quantity/amount switch 136. This is convenient for the totaling.

Figure 5E:
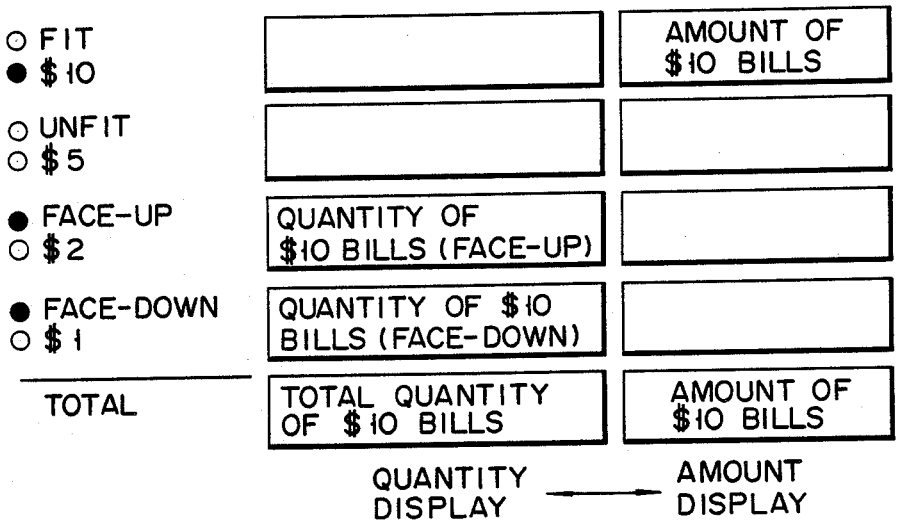

In facing mode (B-2) with one denomination specified, face-up bills of the specified denomination are stacked in the upper stacker 18, face-down bills of the specified denomination are stacked in the lower stacker 20, and non-specified denomination bills and reject bills are stacked in the reject stacker 22. FIG. 5E shows the display in this mode in a case when $10 is specified. When the quantity display is selected, the quantity of the $10 bills (face-up) stacked in the upper stacker 18 is displayed on the third row, the quantity of the $10 bills (face-down) stacked in the lower stacker 20 is displayed on the fourth row, and the quantity of $10 bills (both face-up and face-down), i.e., the sum of the quantities displayed on the third and fourth rows, is displayed on the fifth row. When the amount display is selected, the total amount of the $10 bills (both face-up and face-down) is displayed on the first and fifth rows.

Figure 5F:
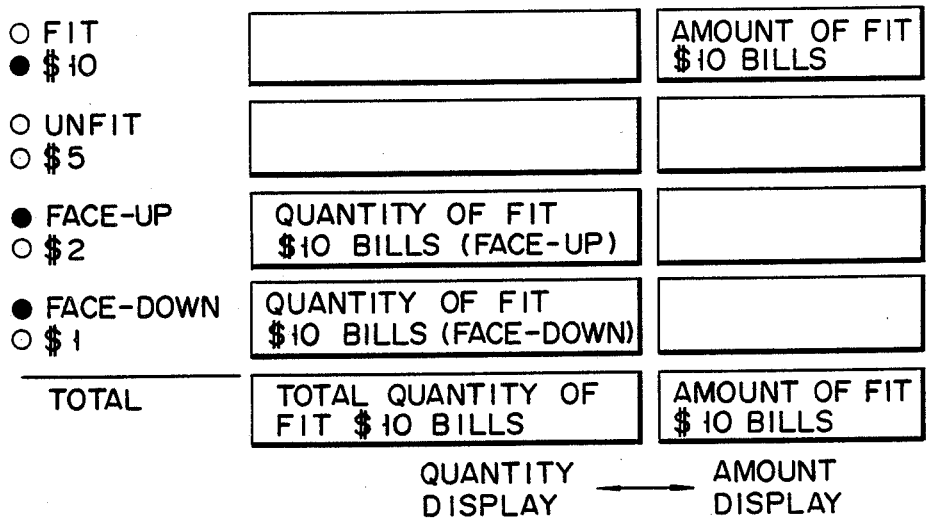

In the fit mode (C), fit bills (face-up) of the specified denomination are stacked in the upper stacker 18, fit bills (face-down) of the specified denomination are stacked in the lower stacker 20, and unfit bills of the specified denomination, non-specified denomination bills, and reject bills are stacked in the reject stacker 22. FIG. 5F shows the display in this mode when $10 is specified. When the quantity display is selected, the quantity of the fit $10 bills (face-up) stacked in the upper stacker 18, quantity of the fit $10 bills (face-down) stacked in the lower stacker 20, and quantity of the fit $10 bills (both face-up and face-down) are displayed in the third to fifth rows, respectively. When the amount display is selected, the amount of the fit $10 bills is displayed on the first and fifth rows.

Figure 5G:
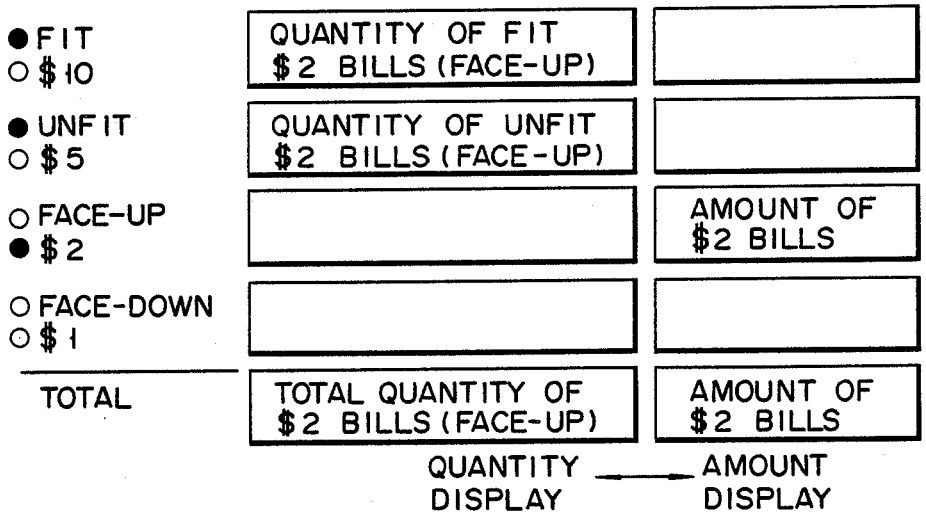

In the fit/unfit mode (D), fit bills (face-up) of the specified denomiation are stacked in the upper stacker 18, unfit bills (face-up) of the specified denomination are stacked in the lower stacker 20, and bills of the specified denomination (face-down), non-specified denomination bills, and reject bills are stacked in the reject stacker 22. FIG. 5G shows the display in this mode when $2 is specified. When the quantity display is selected, the quantity of the fit $2 bills (face-up) stacked in the upper stacker 18 is displayed on the first row, the quantity of unfit $2 bills (face-up) stacked in the lower stacker 20 is dislayed on the second row, and the quantity of the face-up $2 bills, i.e., the sum of the quantities displayed on the first and second rows, is displayed on the fifth row. When the amount display is selected, the total amount of the fit and unfit $2 bills (face-up) is displayed on the third and fifth rows.

Of the various modes described above, the count and facing modes (A) and (B) may be regarded as count-oriented modes. The fit and fit/unfit modes (C) and (D) may be regarded as arrangement-oriented modes for arranging bills after execution of the count-oriented modes. Further, all the modes but the count mode (A-1) without any denomination specified may be regarded as specified-denomination bill-sorting modes. In the mode (A-1), when the specified quantity of bills is stacked in either upper or lower stacker, the stacker is automatically switched over to the other. The bills stacked in the former stacker are taken out while the latter stacker is operative for stacking. It is to be appreciated that with this arrangement the sorting operation need not be interrupted every time a stacker becomes full.

In the mode (A-2), the non-specified denomination bills and reject bills are stacked in the separate stackers 20 and 22, which can increase the efficiency of further sorting operations.

In the modes (C) and (D), in which only one denomination is specified, the judgment regarding two denominations is completed only by judging whether the bill is of the specified denomination or not. Therefore, denomination judgement can be done in a short period of time.

Now, the operation of the embodiment will be described with reference to the flow charts of FIGS. 6A through 11 regarding the operation of the control circuit shown in FIG. 4.

Figure 6A:
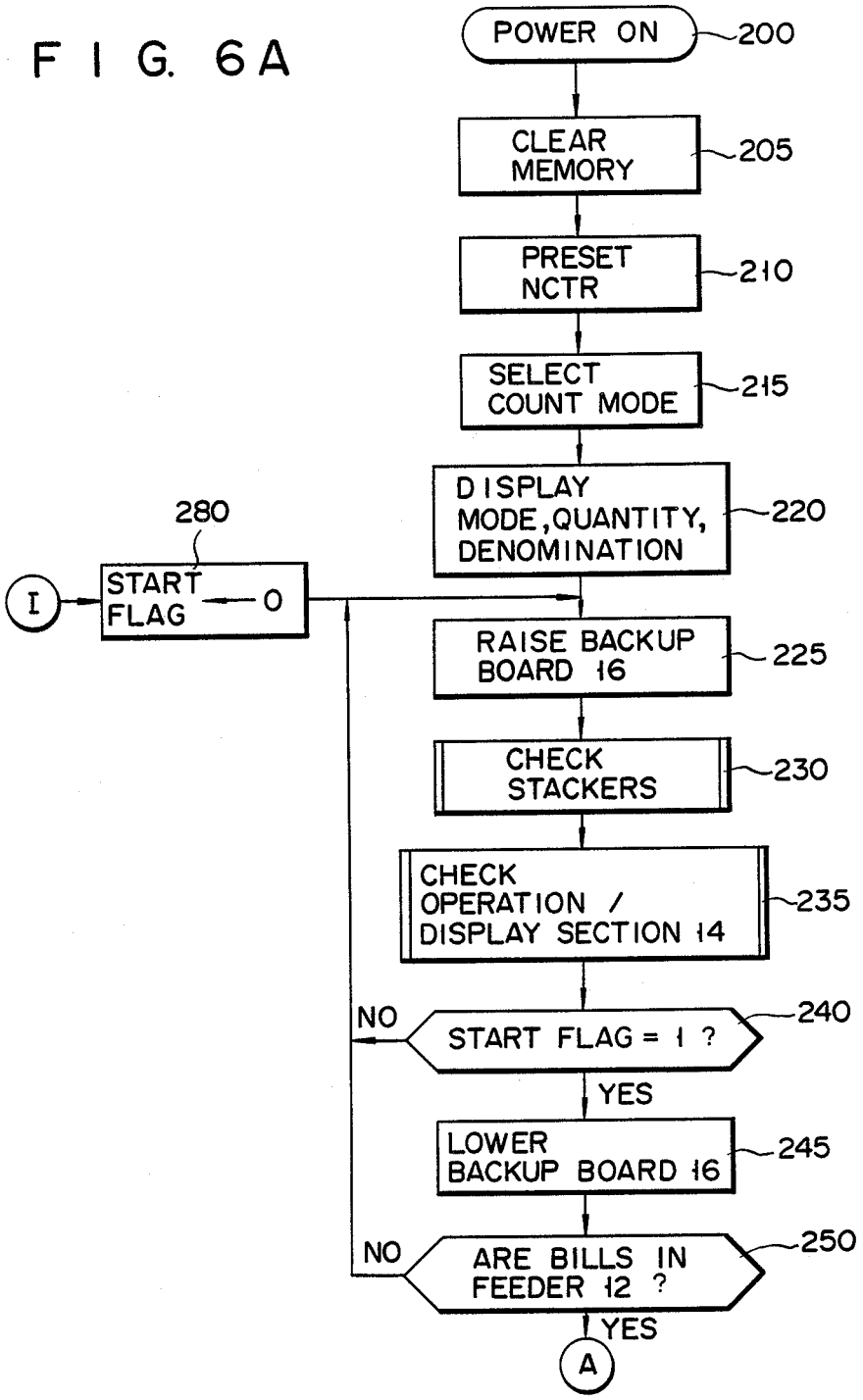
FIGS. 6A through 6C are flow charts illustrating the main routine of operation of the embodiment.
Figure 6B:
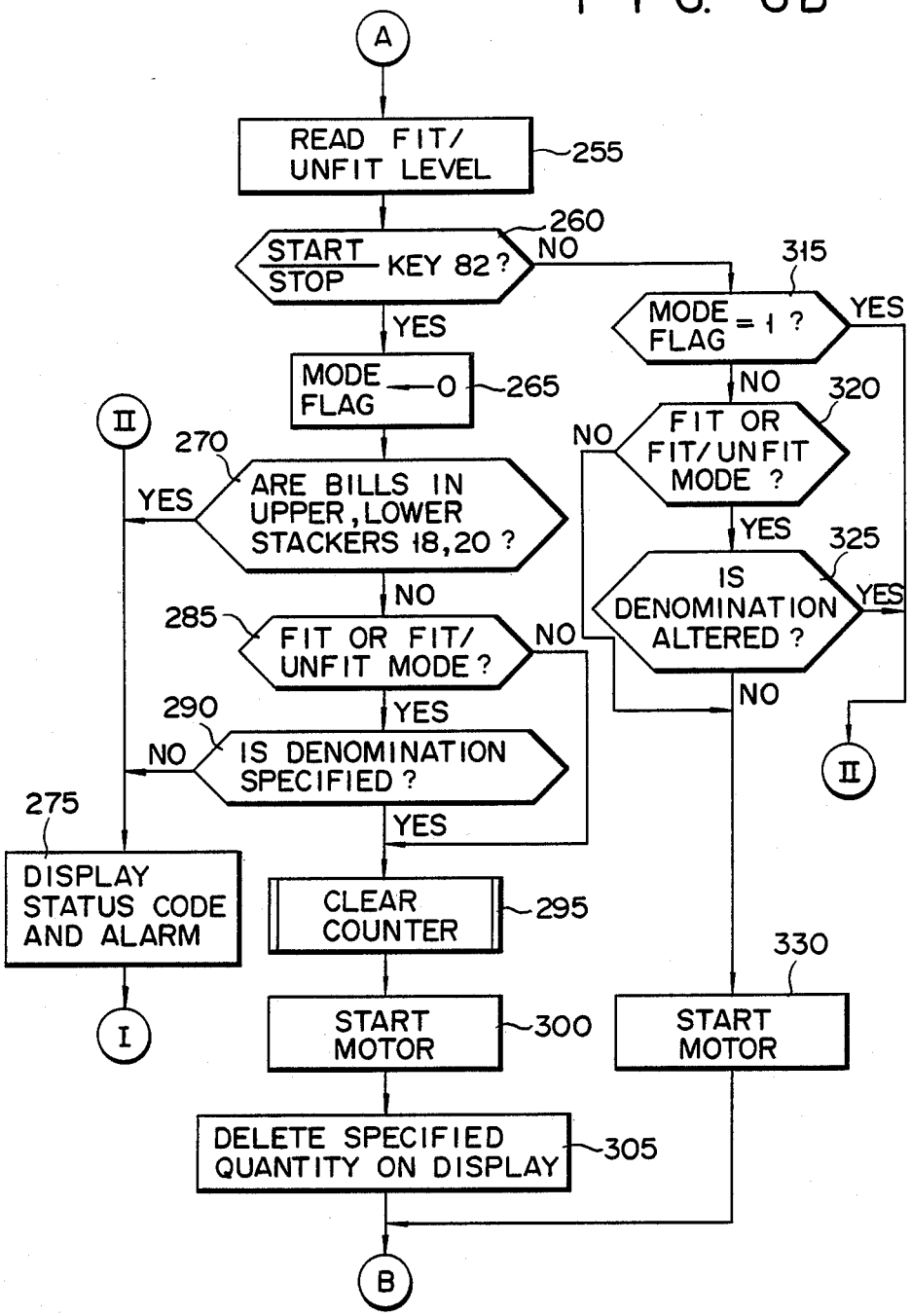
Figure 6C:
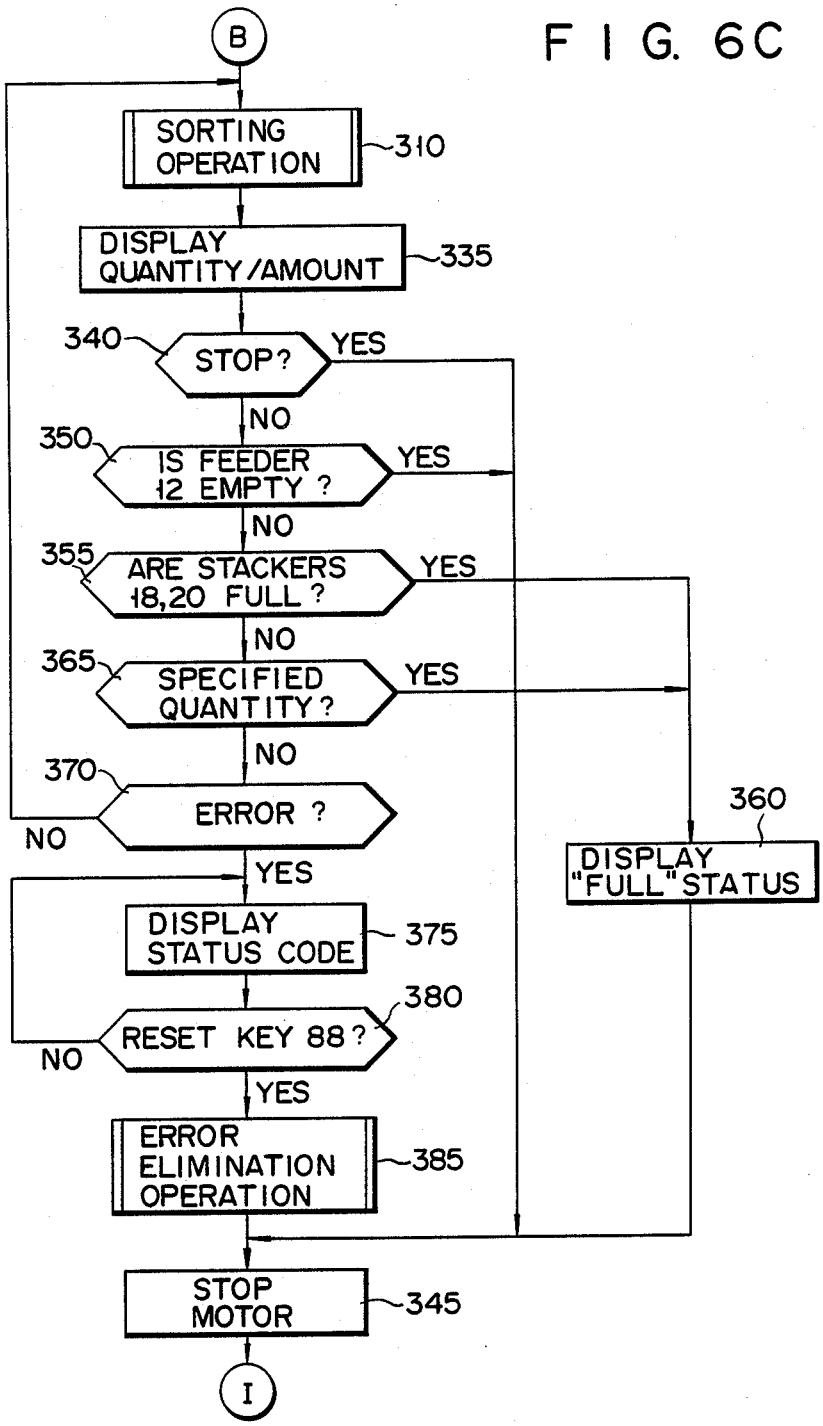

FIGS. 6A through 6C are flow charts showing the main routine of the operation. When power is turned on (step 200), the data memory 160 is cleared in step 205. In step 210, data are preset in NCTR CTRs, i.e., data 200 in the count and facing mode quantity CTRs and 100 in the fit and fit/unfit mode quantity CTRs. In step 215, the count mode (A-1) is selected. It is possible to select any other mode than the mode (A-1) at this time. In step 220, the selected mode and specified quantity and denomination are displayed.

Figure 7A:
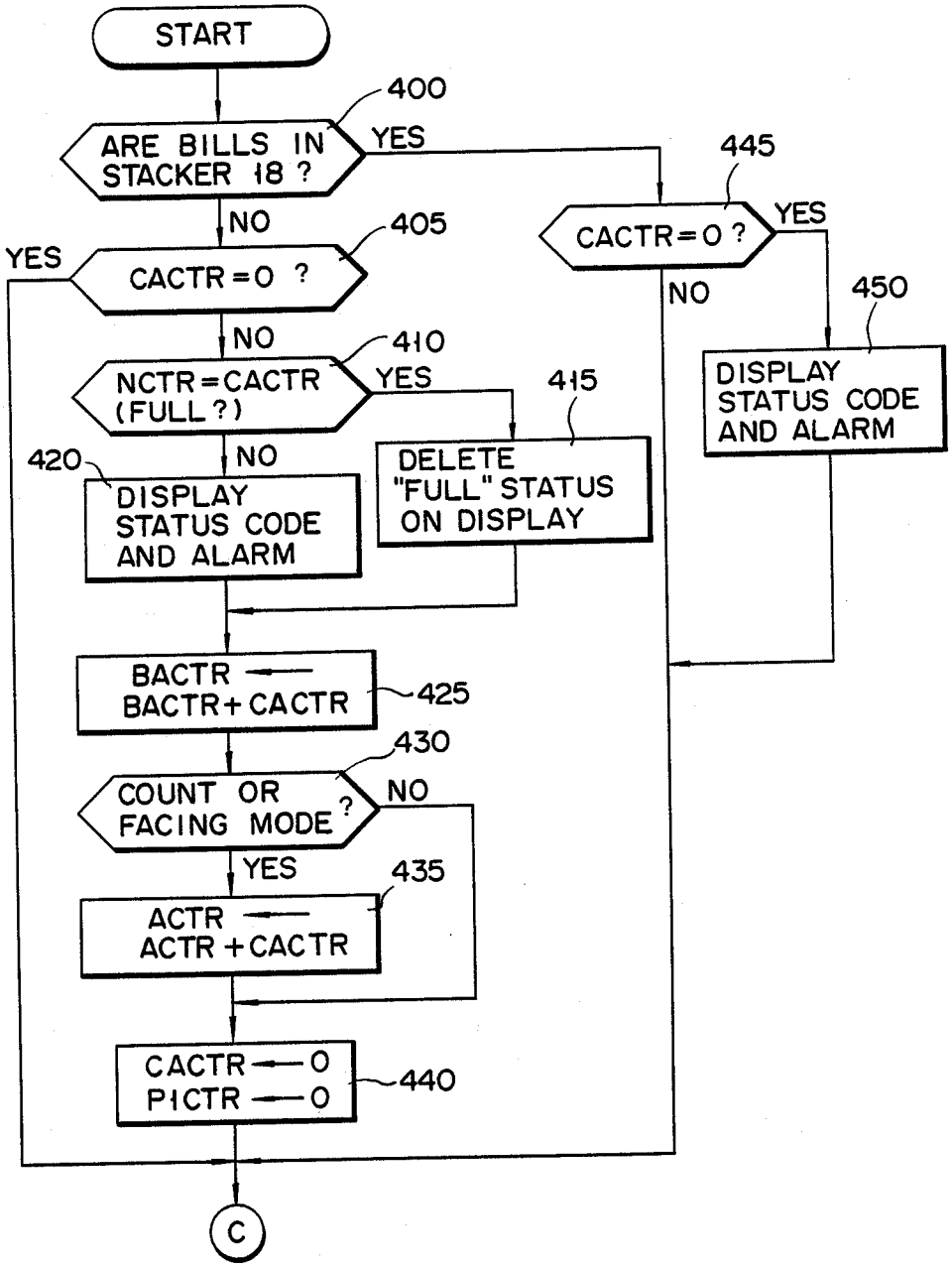
FIGS. 7A through 7C are flow charts illustrating a stacker check subroutine in the main routine.
Figure 7B:
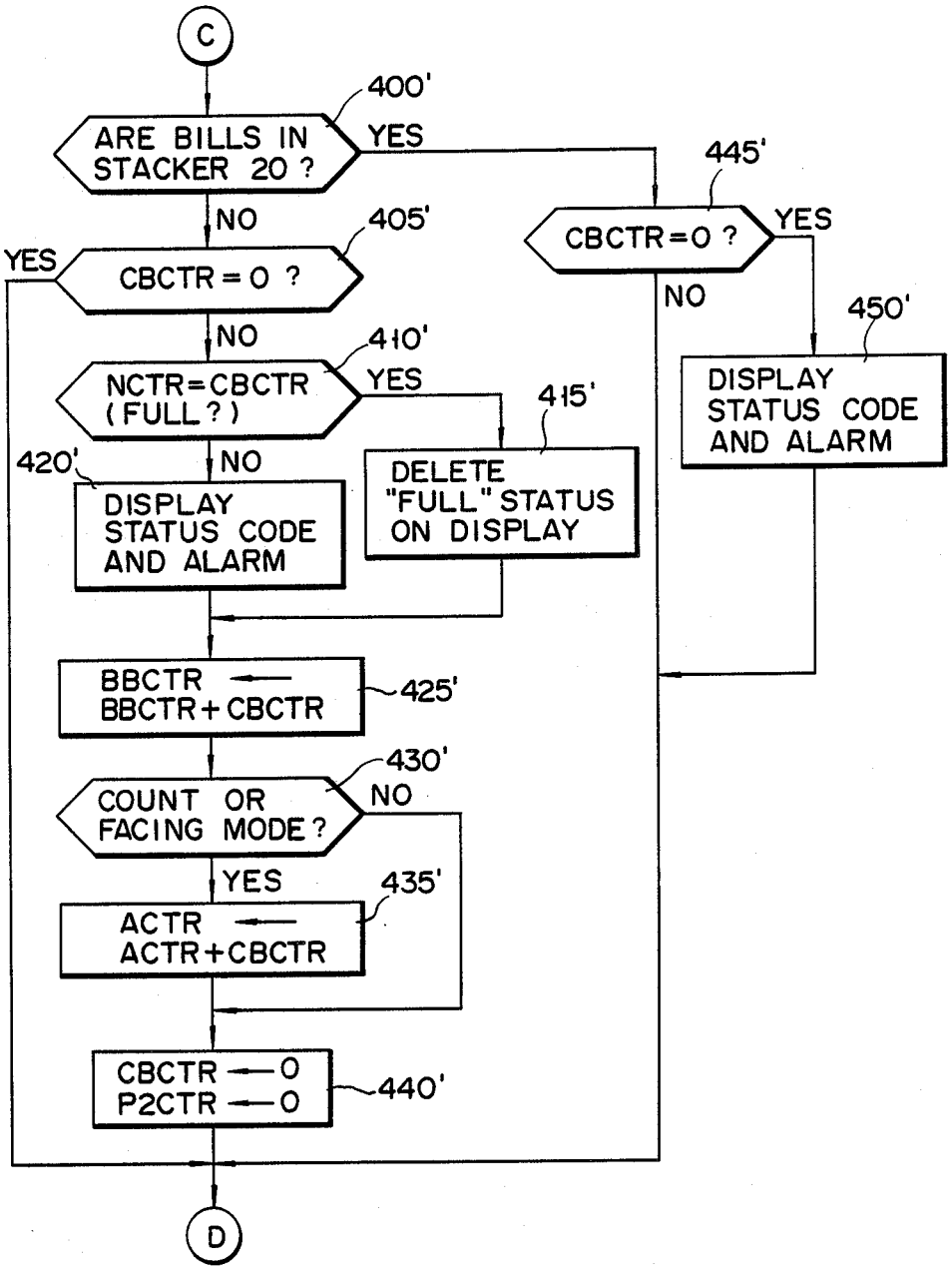
Figure 7C:
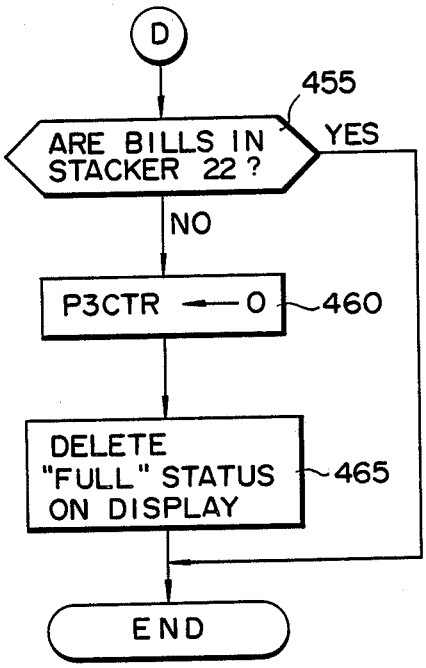
Figure 8A:
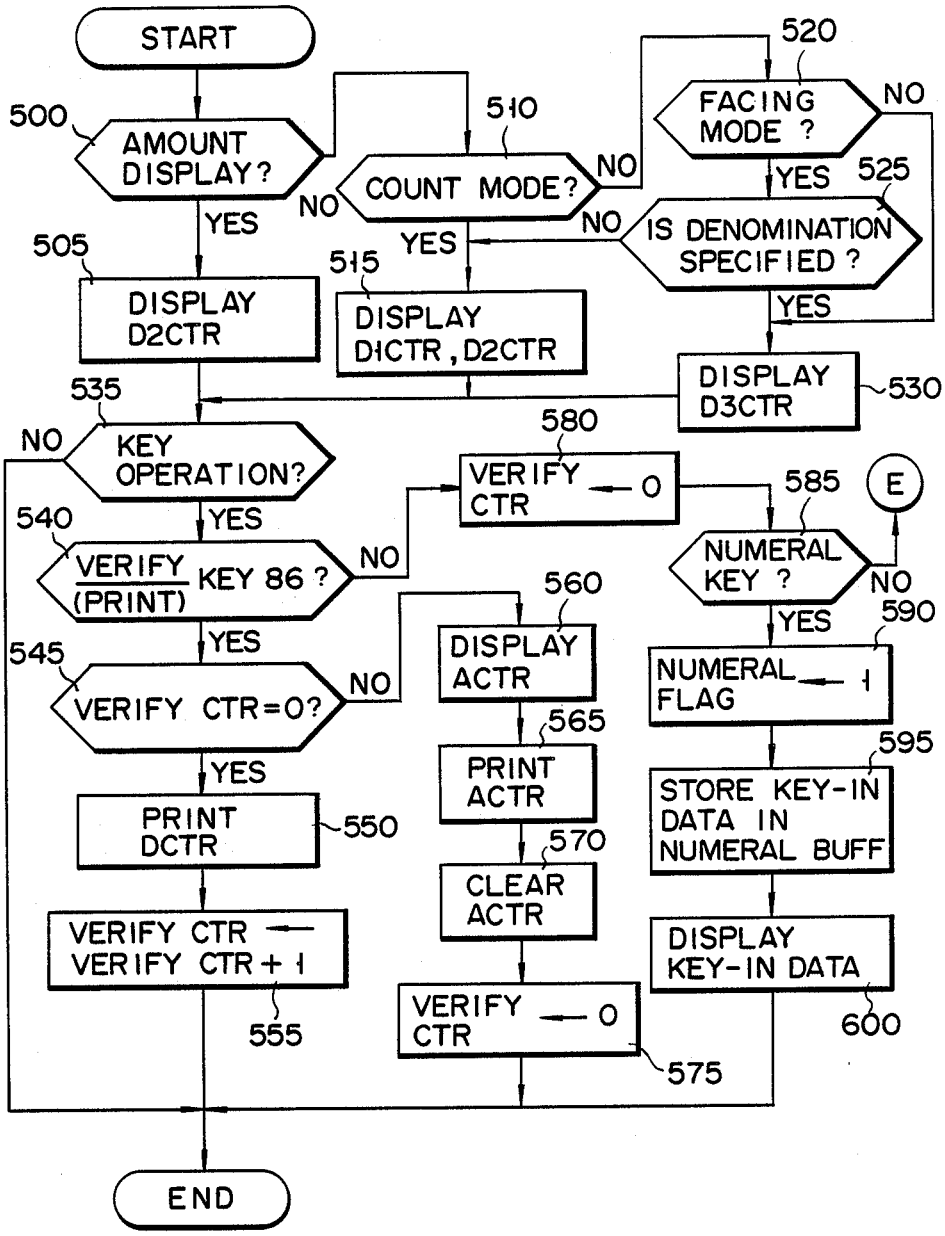
FIGS. 8A through 8C are flow charts illustrating an operation/display panel check subroutine in the main routine.
Figure 8B:
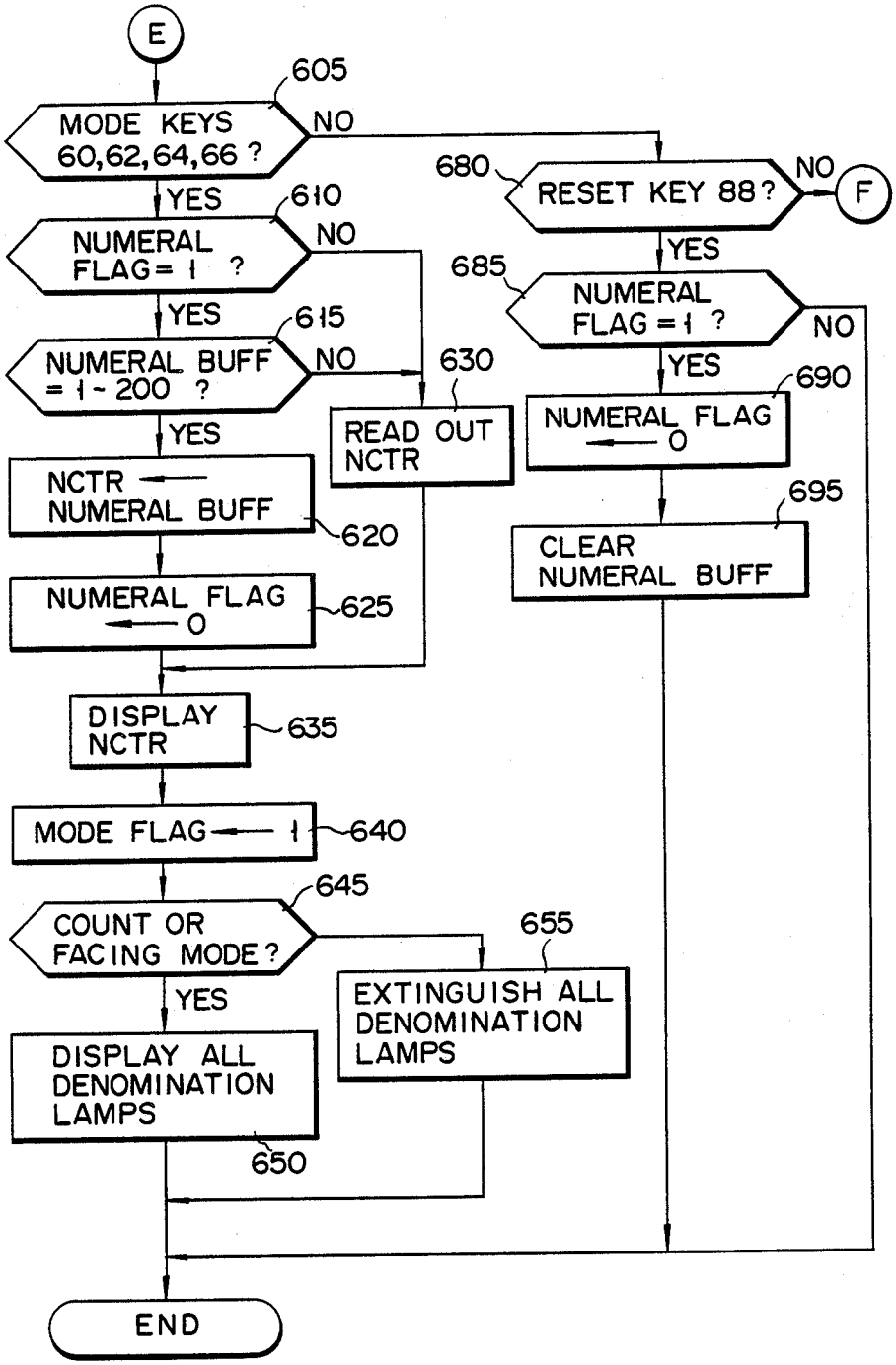
Figure 8C:
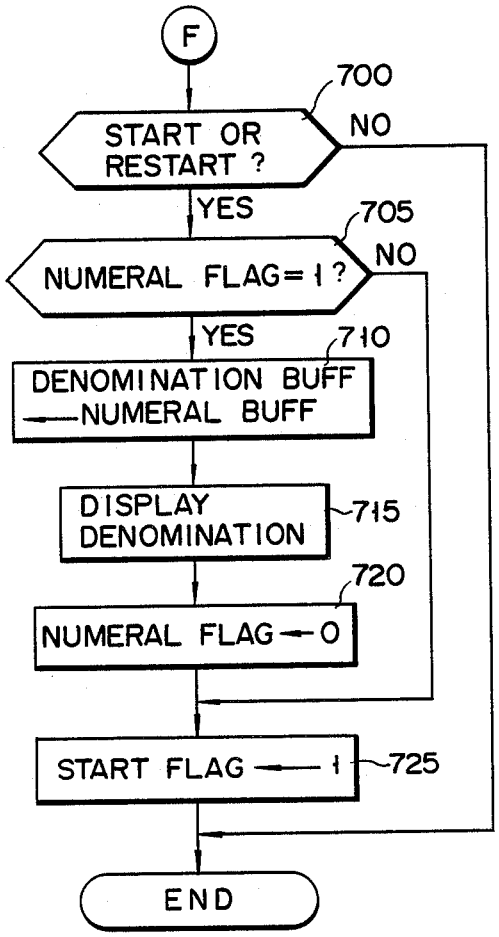
Figure 9:
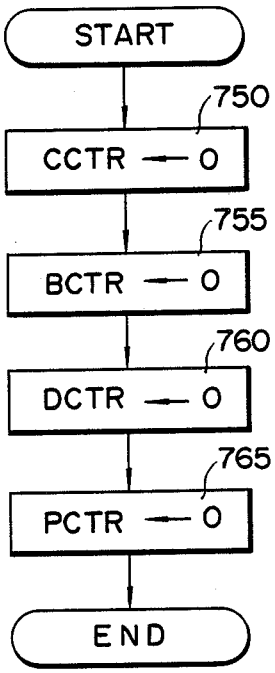
FIG. 9 is a flow chart showing a counter clear subroutine in the main routine.
Figure 10:
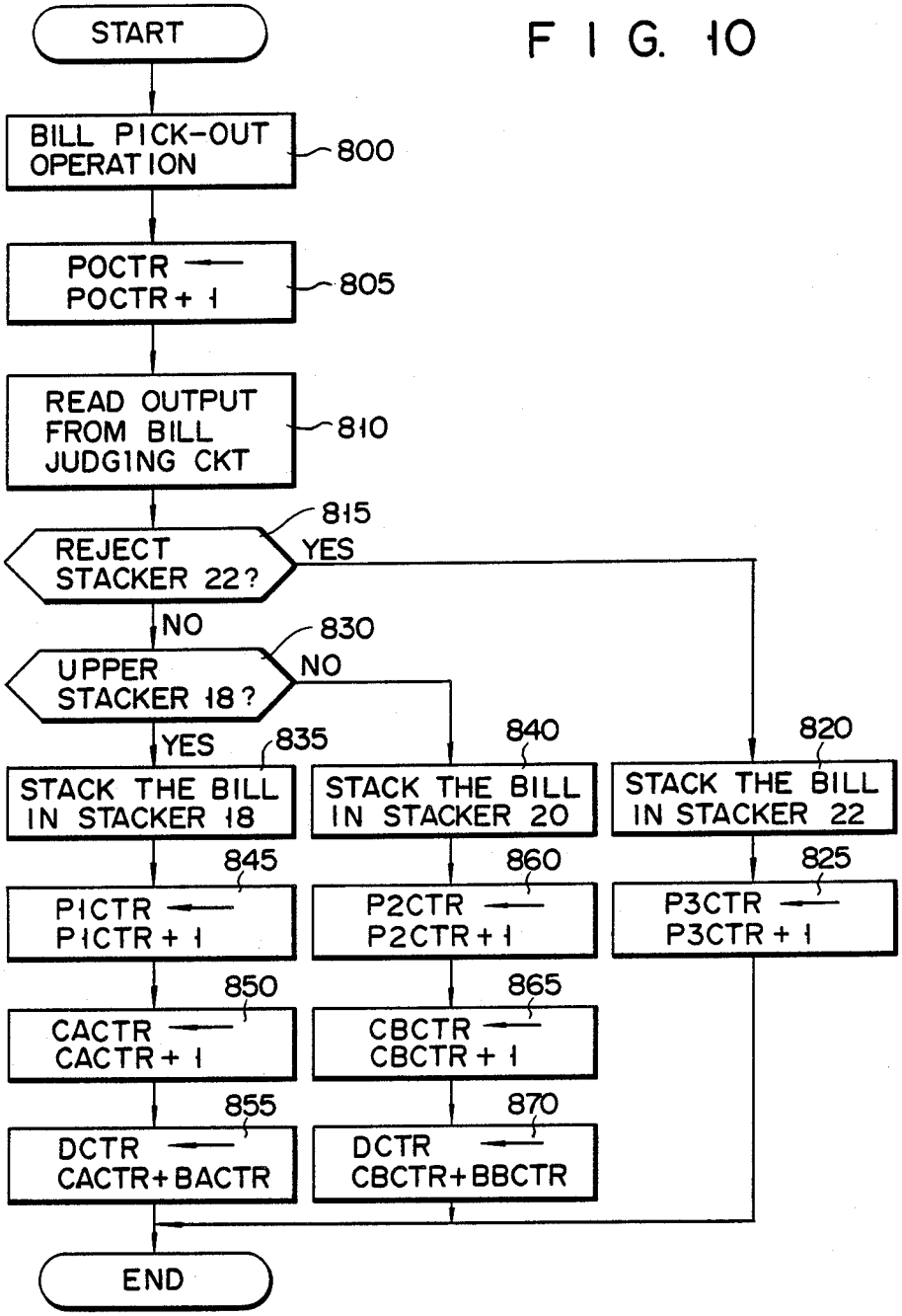
FIG. 10 is a flow chart illustrating a sorting subroutine in the main routine.

In step 225, the backup board 16 at the feeder 12 is raised. At this time, bills to be sorted are set in the feeder 12 by the operator. Subsequently, data concerning the mode, etc., are input by the operator by operating various keys. In step 230, the stackers are checked. The details of this step 230 are shown in FIGS. 7A through 7C. In step 235, the operated keys on the operation/display panel 14 are checked. The details of this step 235 are shown in FIGS. 8A through 8C. After the various data necessary for the sorting operation have been set, the start/stop key 82 is depressed by the operator to instruct the start of sorting operation. When this key 82 is depressed while the apparatus is out of operation, a data "1" is set to the start flag. Whether the start flag is "1" is checked in step 240. If it is not "1", the routine returns to the step 225. If it is "1", the backup board 16 is lowered to hold the bills set in the feeder 12 in step 245. In step 250, according to the output of the bill detector 38, it is determined, whether there are bills in the feeder 12. If there is no bill in the feeder 12, the routine returns to step 225. If there are bills, the fit/unfit level provided from the fit/unfit level switch 26 is read out in step 255. It is to be noted that the fit/unfit level is read out and latched before the start of operation, so that there is no possibility of erroneous operation due to a change in the fit/unfit level that might otherwise occur during the operation. The start flag is set to "1" not only by the start/stop key 82 and also by the restart key 84, as will be described later in detail. For this reason, whether the start/stop key 82 has been depressed is checked in step 260. When the start/stop key 82, not the restart key 84, has been depressed, a data "0" is set to a mode flag in step 265. In step 270, according to the output of the bill detectors 48 and 50, it is determined whether there are bills in the upper and lower stackers 18 and 20. Usually, before instructing the start of operation by depressing the start/stop key 82, the stackers 18, 20, and 22 must be emptied by removing previously sorted bills, if any. If it is determined that there are remaining bills in any of the upper and lower stackers 18 and 20, a status code representing the faulty status is displayed and also an alarm is generated in step 275, and then a data "0" is set to the start flag in step 280. The routine then is returned to step 225. If no remaining bills are detected in step 270, it is determined in step 285 whether or not the selected mode is the fit mode or fit/unfit mode. If the selected mode is in the fit or fit/unfit mode, it is determined in step 290 whether a denomination is specified. When the denomination is not specified, the routine returns through step 275 and 280 to step 225. If the fit or fit/unfit mode is selected and a denomination is specified, the CTRs are cleared in step 295. The details of step 295 are shown in FIG. 9. In step 300, the motor as the drive source for the feeder 12 and transporter 30 is started. In step 305, the specified quantity on display, started in step 230, is deleted. This is done for the purpose of the display of the quantities of sorted bills. Since the display section is used in the time sharing manner, it may be small in size. Then, the sorting operation is performed in step 310. The details of the sorting operation are shown in FIG. 10.

If it is determined in step 260 that the data "1" is set to the start flag by depressing the restart key 84, in step 315 it is determined whether the mode flag is "1". The restart key 84 is operated for resuming the sorting operation on a lot of bills set in the feeder 12 after it has been interrupted in such a case as when the specified quantity is stacked in the stacker 18 or 20. The data "1" is set to the mode flag when a mode specification key is depressed, as will be described later in detail. When the restart key 84 has been depressed and the mode flag is "1", it is likely that the mode is changed by depressing a different mode specification key. Accordingly, if it is detected in step 315 that the mode flag is "1", step 275 is executed, in which the status code is displayed and an alarm is generated, and the routine subsequently returns through step 280 to step 225. If the mode flag is "0" in step 315, it is determined in step 310 whether or not the selected mode is the fit mode or fit/unfit mode. If the selected mode is the fit mode or fit/unfit mode, it is determined in step 325 whether the specified denomination is altered. If an alteration of the denomination is detected in step 325, the prevailing status is faulty. In this case, step 275 is again executed in order to display error status. If it is determined in step 320 that the selected mode is not the fit or fit/unfit mode and it is determined in step 325 that there is no alteration of denomination, the prevailing status of the apparatus is normal. In this case, the motor is started in step 330 for the sorting operation (i.e., step 310).

As has been shown, when the restart key 84 is depressed, the motor is started for resumption of the sorting operation after it has been confirmed that the selected mode and the specified denomination have not been altered. Thus, an erroneous sorting operation can be prevented.

Figure 11:
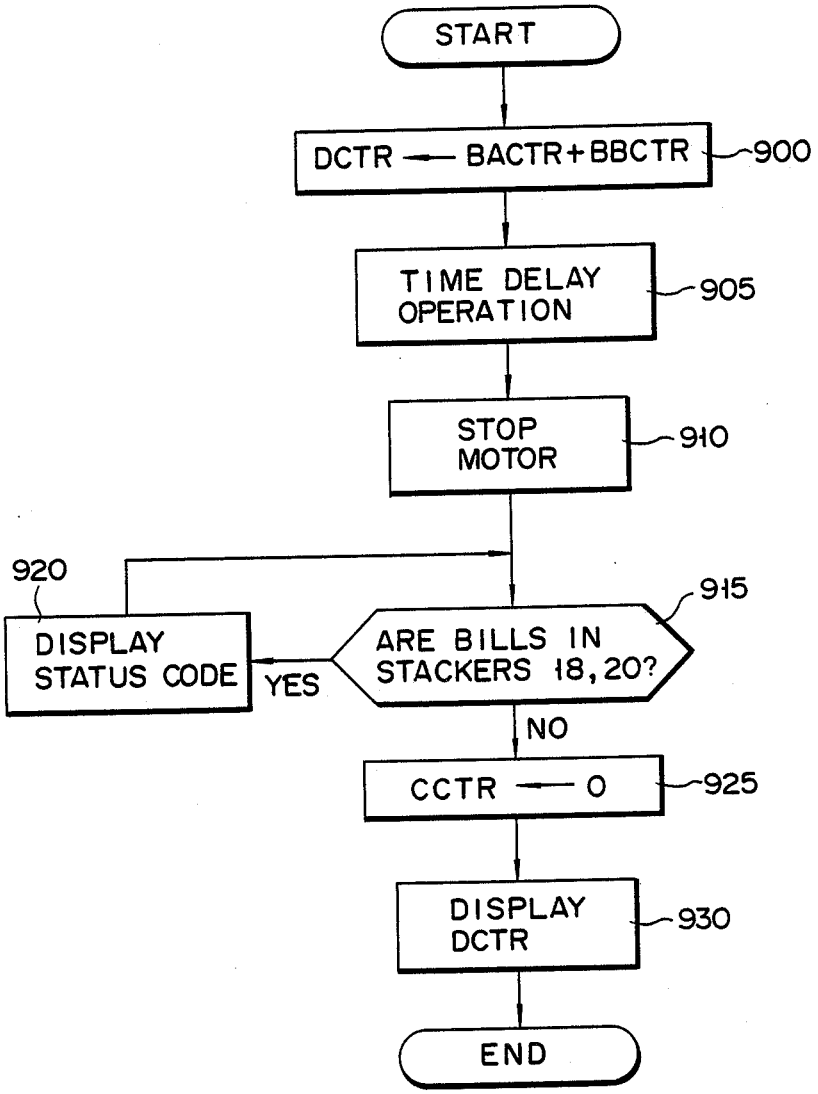
FIG. 11 is a flow chart illustrating an error removal subroutine in the main routine.

The sorting operation (step 310) is performed for one bill. When it is completed, the display of the DCTR data, i.e., quantity or amount data of the sorted bills, is updated in step 335. In step 340, it is determined whether a stop instruction is provided from the start/stop key 82. If the stop instruction is detected, the motor is stopped in step 345. Subsequently, the start flag is reset to "0" in step 280, and the routine is returned to step 225. If there is no stop instruction, step 350 is executed, in which, according to the output of the bill detector 38, it is determined whether the feeder 12 is empty with all the bills having been fed therefrom into the body. If the feeder 12 is empty, the motor is stopped in step 345, and the routine is returned through step 280 to step 225. If the feeder 12 is not empty, it is determined in step 335 whether either the upper or lower stacker 18 or 20 is full. If one of the stackers is full, the "full" status is displayed in step 360, and then the motor is stopped (step 345). Otherwise, it is determined in step 365 whether the bills are stacked in the stackers 18 and 20 up to the specified quantity. If the quantities of the stacked bills are a specified quantity, step 360 of displaying the "full" status is excuted and the motor is stopped (step 345). If the specified quantities of bills have not yet been stacked, step 370 is executed, in which it is determined whether there is any error or faultiness, e.g., jamming, etc., according to the output of the jamming detector (not shown), etc. If no fault is detected, the next sorting operation (step 310) is executed. If a fault is detected, a status code representing it is displayed in step 375. The status code is displayed until the reset key 88 is depressed in step 380. With the depression of the reset key 88, an error elimination step (step 385) is executed. Then the motor is stopped (step 345). The details of the step 385 are shown in FIG. 11.

The step 230 of checking the stackers will now be described in detail with reference to FIGS. 7A through 7C. It is determined in step 400 whether there are bills in the upper stacker 18 in order to confirm that the bills are taken out from the stacker 18. It is determined according to the output of the bill detector 48. If there are no bills in the stacker 18, it is determined in a step 405 whether the CACTR data for the upper stacker 18 is "0". If it is "0", steps concerning the lower stacker 20, as shown in FIG. 7B, are executed. The steps with respect to the lower stacker 20 are similar to those with respect to the upper stacker 18, and corresponding steps are designated by like reference numerals in FIG. 7A with a prime number. If the CACTR data is not "0", it is determined in step 410 whether the bills are taken out after the specified quantity of bills have been stacked, i.e., whether the CACTR data is equal to the NCTR data. If the two data are equal, the "full" status display is deleted in step 415 in order to indicate that the stacked bills are taken out from the stacker 18 in a regular manner. If they are not equal, a status code representing the erroneous take-out is displayed and an alarm is generated in step 420. In step 425, the data representing the quantity of the taken-out bills is accumulated (BACTR←BACTR+CACTR). If a bundle of bills not having the specified quantity are taken out from the stacker 18, an alarm display and alarm sound are produced to prevent erroneous operation. In subsequent step 430, it is determined whether or not the selected mode is a count mode or facing mode. If the selected mode is the count or facing mode, the CACTR data is accumulated (ACTR←ACTR+CACTR) in step 435. In step 440, the CACTR and P1CTR are cleared, and the routine proceeds to the steps with respect to the lower stacker 20. If it is detected in step 430 that the mode is the fit or fit/unfit mode, the accumulation step 435 is not executed, and the CACTR and P1CTR are immediately cleared in step 440. The quantity data CACTR, CBCTR for both the upper and lower stackers 18 and 20 are accumulated in the ACTR. The accumulation of the quantities is done only in the count and facing modes. That is, the accumulation of the quantities of sorted bills is done only in a mode, the main purpose of which is to count bills as in a depositing process in a bank, etc. An accurate depositing process thus can be guaranteed.

If it is detected in step 400 that there are bills in the upper stacker 18, it is determined in step 445 whether the CACTR data is "0". This is done because when the bills are taken out, the CACTR data becomes "0", and when bills are returned to the stacker, step 400 yields a "yes" decision, indicating that there are bills remaining in the stacker 18. If it is detected in the step 445 that the CACTR data is "0", the faulty status code is displayed and an alarm is generated in step 450, and the routine proceeds to the steps with respect to the lower stacker 20. If the CACTR data is not "0", which indicates that the bills have not yet been taken out, the steps with respect to the lower stacker 20 are immediately executed.

As has been shown, it is determined whether the bills are correctly taken out and whether the takenout bills are returned, so that it is possible to prevent an erroneous bill bundling operation subsequent to the sorting operation.

When the steps with respect to the lower stacker 20, as shown in FIG. 7B, subsequent to the steps with respect to the upper stacker 18 are completed, step 455 shown in FIG. 7C is executed, in which it is determined, according to the output of the bill detector 52, whether bills have been taken out from the reject stacker 22. If there is no bill in the stacker 22, the P3CTR is cleared in step 460. In step 465, the "full" status display is deleted to bring an end to step 230. If it is detected in step 455 that there is any bill in the stacker 22, it brings an end to the step.

Now, step 235 of checking the operation/display panel will be described with reference to FIGS. 8A through 8C. First, the state of the quantity/amount switch 136 is determined in step 500. If it is detected that the amount display is selected, the D2CTR amount data for the selected mode is displayed in step 505. If it is detected that the quantity display is selected, it is determined in step 510 whether the mode is the count mode (A). If this is so, that part of the D1CTR and D2CTR amount data which corresponds to the selected mode is displayed in step 515. If the mode is not the count mode (A), it is determined in step 520 whether the mode is a facing mode. If this is so, it is determined in step 525 whether a denomination is specified. If no denomination is specified, i.e., if the mode is the mode (B-1), the display is the same as in the case of the count mode (A-1), as shown in FIGS. 5A and 5D, so that step 515 is executed as in the count mode (A) case. If it is detected in step 525 that a denomination is specified and it is detected in step 520 that the mode is not a facing mode but is a fit or fit/unfit mode, step 530 is executed, in which the D3CTR quantity data corresponding to the mode is displayed. At this time, only the numerical data on the right side of either one of FIGS. 5A to 5G is displayed, and the left side denomination/category lamps are turned on later.

Subsequent to display step 505, 515 or 530, it is determined in step 535 whether any key is operated. If no key operation is detected, it brings an end to step 235. If key operation is detected, it is determined in step 540 whether the operated key is the verify (print) key 86. If this is so, it is determined in a step 545 whether the verify CTR data is "0". The verity CTR, as will be described later in detail, is set to "1" when the verify (print) key 86 is operated once and reset to "0" when a different key is depressed subsequent to the key 86. In step 545, the verify CTR data is thus determined to be "0" if the verify (print) key 86 is operated for the first time. When the key 86 is operated for the second time, the verify CTR data is determined to be "1". However, it is determined to be "0" if the key 86 is operated again after a different key is operated subsequent to the first operation of the key 86. In other words, it is determined in step 545 whether the verify (print) key 86 alone is operated twice in succession. The operation of the key 86 for the first time produces a print command, and the two consecutive operations of the sole key 86 produce a verify command. This arrangement, i.e., a single key capable of providing two different operation commands, can reduce the number of necessary operation command keys. When the sole key 86 is operated twice in succession, the printing is executed in response to the first key operation. With the verify CTR data determined to be "0" in respect to the first key operation, the DCTR data on display is printed in step 550. In step 555, the verify CTR data is increased by 1, bringing an end to step 235.

If it is detected in step 545 that the verify CTR data is not "0" but "1", the ACTR total quantity or amont data is displayed in step 560. In step 565, the ACTR data is printed, then the ACTR is cleared in step 570, and then the verify CTR is cleared in step 575 to bring an end to step 235. The term "verify" means the printing and displaying of the ACTR data.

If it is detected in step 540 that a different key from the verify (print) key 86 is operated, the verify CTR data is reset to "0" in step 580. In step 585, it is determined whether the operated key is numeral keys 76. The operation of the numeral keys 76 will be described only in the case when they are operated for the specification of denomination and quantity, and the description in connection with the input of an account number, a transaction number, etc., will not be given. If it is detected that numeral keys 76 are operated, a data "1" is set to a numeral flag in step 590. In step 595, the key-in numeral data is stored in a numeral buffer. In step 600, the key-in data is displayed on the fifth display row 114 in the display section 116. At this instant, it is not determined yet that the key-in data represents a denomination or a quantity. If it is determined in step 585 that no numeral key is operated, it is determined in step 605 whether any one of the mode specification keys 60, 62, 64, and 66 is operated. If the operation of a mode key is detected, it is determined in step 610 whether the numeral flag is "1". That is, it is determined whether numeral key operation has been done before the specification of a mode. Since the numeral flag is set to "1" with the operation of a numeral key, if the numeral flag is "1", it means that a numeral key is depressed before the mode specification. If the numeral flag is "1", it is determined in step 615 whether the data in the numeral buffer is between the integral of 1 and 200. A key-in numeral data, input before the mode specification, is regarded as specified quantity data, while the key-in data after the mode specification is regarded as specified denomination data. In other words, if a mode specification key is operated after the numeral key operation, the key-in numeral data is deemed to represent a specified quantity, and if no key is operated after the numeral key operation, the key-in numeral data is regarded as specified denomination data upon operation of the start key. For this reason, if it is determined that the numeral flag is "1" and the data in the numeral buffer (key-in numeral data) represents one of the integral numbers 1 to 200, the numeral buffer data is transferred to the NCTR quantity CTR for the corresponding mode in step 620, and the numeral flag is reset to "0" in step 625. As is shown, the use of the numeral flag permits the key-in numeral data to represent either denomination or quantity, thus permitting the reduction of keys.

If the numeral flag is not "1" or if the key-in data does not represent any of the integral numbers 1 to 200 although the numeral flag is "1", the preset NCTR data is read out in step 630. That is, if the numeral flag is not "1" or also if the key-in data presents a different number from the numbers 1 to 200 even though the numeral flag is "1", it is regarded that there is no quantity specification or alteration. Subsequent to steps 625 and 630, the NCTR data is displayed in step 635.

Since the quantity specification NCTR is provided for each mode, it is not always necessary to alter the specified quantity when the mode is altered, which is convenient for operation. In addition, the quantity specifications CTRs for the individual modes are preset to the most general values when power is turned on, so that negligence of specified quantity setting gives rise to no substantial trouble.

Further, the specified quantity is displayed until the start of step 305 for feeding bills into the body, as described before in connection with FIG. 6A, to prevent erroneous recognition of the specified quantity by the operator. Furthermore, the specified quantity display space can also be used for displaying the quantity of sorted bills. Subsequent to step 635, the mode flag is set to "1" in step 640. In step 645, it is determined whether or not the selected mode is a count mode or facing mode. If the selected mode is a count or facing mode, all denomination lamps are turned on in step 650. If the mode is the fit or fit/unfit mode, all denomination lamps are extinguished in step 655.

If it is determined in step 605 that no mode key is operated, it is determined in step 680 whether the reset key 88 is operated. If it is detected that the reset key 88 is operated, it is determined in step 685 whether the numeral flag is "1", i.e., whether there is previous key-in numeral data. If there is no previous key-in data, it brings an end to step 235. If there is previous key-in data, the numeral flag is reset to "0" in step 690, and the key-in data, i.e., numeral buffer data, is cleared and the display of the key-in data is deleted in step 695 to bring an end to step 235.

If it is detected in step 680 that the reset key is not operated, it is determined in step 700 whether a start or restart is commanded by the start/stop key 82 or restart key 88. If it is determined that neither start or restart is commanded, it brings an end to the step 235. If a start or restart is detected, it is determined in step 705 whether the numeral flag is "1". If the numeral flag is "1", it means that there is previous key-in data, and in this case the key-in data is regarded as representing a specified denomination as described above. That is, in this case the numeral buffer data is transferred to the denomination buffer in step 710, thus effecting the denomination specification. In step 715, the corresponding denomination lamp is turned on to be recognized by the operator. In step 720, the numeral flag is reset to "0", and then the start flag is set to "1" in step 725, thus bringing an end to step 235. If it is determined in step 705 that the numeral flag is not "1", it means that there is no previous key-in data and no denomination specification. In this case, step 725 is immediately executed.

Now, the counter clearing step 295 will be described in detail with reference to FIG. 9. This subroutine is executed when a sorting operation start command is given by the operation of the start/stop key 82. It consists of step 750 of clearing the CCTR, step 755 of clearing the BCTR, step 760 of clearing the DCTR, and step 765 of clearing the PCTR. The ACTR for accumulation is of course not cleared. Although not shown in FIG. 6B, the CCTR, DCTR, and PCTR are also cleared upon the delivery of the restart command.

Step 310 of sorting operation will now be described in detail with reference to FIG. 10. First, a bill is picked up from the feeder 16 and fed into the body in step 800. Step 800 is executed approximately 10 times per second as mentioned earlier. In subsequent step 805, the P0CTR data is increased by 1. In step 810, the output of the bill judging circuit 32 representing the result of judgement is read out. In step 815, it is determined whether the judged bill is a reject bill to be stacked in the reject stacker 22. If so, the flapper 36 is controlled to direct the bill to the reject stacker 22 in step 820. Then, the P3CTR quantity CTR for the reject stacker 22 is increased by 1, thus bringing an end to step 310. If it is detected in step 815 that the judged bill is not a reject, it is determined in step 830 whether the bill is to be stacked in the upper stacker 18. If so, step 835 is executed. If not, step 840 is executed. In the steps 835 and 840, the flapper 34 is controlled to lead the bill to the upper and lower stackers 18 and 20, respectively. Subsequent to step 835, the P1CTR quantity data is increased by 1 in step 845, the CACTR quantity data is increased by 1 in step 850, and then an operaton DCTR←CACTR+BACTR is executed in a step 855. Likewise, subsequent to step 840 the P2CTR quantity data is increased by 1 in step 860, the CBCTR quantity data is increased by 1 in step 865, and an operation DCTR←CBCTR+BBCTR is executed in step 870. The DCTR data are displayed in step 335 next to the sorting step shown in FIG. 6C, that is, the quantity or amount data are successively updated according to the result of the sorting operation.

In the fit and fit/unfit modes (C) and (D), a denomination must be specified. In order to cope with the negligence of the specification, a means (not shown) is provided, which regards the denomination of the first bill picked up from the feeder and fed into the body as a specified denomination in the event when no specified denomination data is given.

Step 835 of the error elimination operation will now be described in detail with reference to FIG. 11. First, the sum of the BACTR and BBCTR data is transferred to the DCTR in step 900, for the total display of the bills that have already been taken out from the upper and lower stackers 18 and 20. Then, after a predetermined delay time is provided in step 905, a delay time is necessary for the bills on transport to be stacked in the stackers, the motor is stopped in step 910. Usually, the bills are taken out from the stackers after the motor is stopped. In subsequent step 915, it is determined whether there are bills remaining in the stackers 18 and 20. If there are remaining bills a status code representing this is displayed in step 920. If not, the CCTR data is cleared in step 925, and the DCTR data is displayed in step 930 to bring an end to step 385.

When the bills are taken out from the upper and lower stackers 18 and 20 at the time of an error occurrence, the BCTR data is displayed while the CCTR data is cleared. Thus, the total before the error occurrence is made effective, and the sorting for te lot at the time of error occurrence is cancelled. The subsequent operation can thus proceed smoothly.

In the embodiment as described above in the count mode with one denomination specified, an efficient sorting operation can be obtained by stacking the specified denomination bills in one of three stackers, stacking reject bills in the second stacker, and stacking the remaining bills in the third stacker. It is possible to provide more than three stackers. By so doing, the number of categories that can be specified at a time can be increased. For example, with four stackers provided, two groups of specified denomination bills, non-specified denomination bills, and reject bills may be stacked in separate stackers in the count mode with two denominations specified in the above embodiment. Further, in the facing mode, fit mode, and fit/unfit mode the specification of one denomination means that four different categories exist, i.e., fit (face-up), unfit (face-up), fit (face-down) and unfit (face-down), so that it is more desirable to provide four stackers.

In addition, the start and restart of the sorting operation are discriminated from each other, and a restart command is accepted if and only if there is no alteration of specified denomination, selected mode, etc. Further, when bills less than a bundle of bills having the specified quantity are taken out from stacker, an error status code is displayed and also an alarm is produced. Furthermore, an alarm is also produced when bills taken out from a stacker are returned thereto. These measures can eliminate erroneous operation. Still further, although the level for discrimination between fit and unfit bills is variable, it is preset and read out before the start of the sorting operation and is held fixed during the sorting operation. The above embodiment is for use for a wide variety of soring operations and, therefore, requires a number of keys for specifying various modes. In the embodiment, however, two different kinds of key signals can be produced in response to the operation of a single key, depending on whether the key is operated before or after the operation of a predetermined different key. Thus, keys are reduced in number, and the operation/display panel is reduced in size. Further, the display section is used in a time sharing manner, so that the display space is reduced. Further, the keys are arranged in the order of their operation in the normal use of the apparatus, which is desired from the standpoint of the operability of the apparatus.

Moreover, in the above embodiment the desired quantities of sorted bills stacked at one time can be specified for each mode, and once the quantity data are specified, they need not be set again when the mode is changed. Further, the specified quantity data is preset to the most general values when power is turned on, and negligence of the setting of the quantity gives rise to no substantial trouble.

Further, in the count-oriented mode, such as count and facing modes, the quantity or amount of bills taken out from the stackers is accumulated, which is advantageous for a deposite dealing operation.

The above embodiment is by no means limited, and various changes and modifications are possible without departing from the scope and spirit of the invention. For example, the subject of sorting is not limited to bills.

What is claimed is:

1. An apparatus for sorting a mixture of different kinds of sheets fed to the apparatus one by one and stacking the sorted sheets comprising:

feeding means for feeding a mixture of different kinds of sheets one by one;

a plurality of stacking means for stacking said sheets fed by said feeder;

means for judging the type of sheets in said mixture of different kinds of sheets fed by said feeding means;

mode setting means for specifying one of a plurality of modes of sorting said judged type of sheets in said mixture of sheets, which indicates the type of sheet to sort;

means for inputting a quantity of sheets to be sorted in each stacking means for each of said modes of sorting specified by said mode setting means;

memory means having memory sections, each of which stores information relating to the quantity of sheets to be sorted in each stacking means for each of said modes and in which a predetermined number is initially preset, the quantity of sheets to be sorted in each stacking means being variable by said inputting means; and means for transporting the judged sheets to at least one of said stacking means according to the mode of sorting set by said mode setting means, the operation of said transporting means being interrupted when said specified quantity of sheets are stacked in at least one of said stacking means.

2. An apparatus according to claim 1, in which said mode setting means includes a plurality of manual keys arranged in compliance with their mode setting sequence.

3. An apparatus according to claim 1 in which said memory means includes at least one quantity data memory corresponding to each of said modes of sorting, each of said quantity data memories having predetermined quantities established upon initiating operation of said sorting apparatus.

4. An apparatus according to claim 1 in which said stacking means includes a first, second, and third stacker, a first specified type of sheet being stacked into said first stacker, unspecified types of sheets being stacked into said second stacker, and sheets which are not able to be judged being stacked into said third stacker.

5. An apparatus according to claim 1, further including means for storing data corresponding to a preset quantity of sheets for each of said modes, and means for varying the present quantity of sheets for each of said modes.

6. An apparatus according to claim 1, in which said sheets are bills and said mode setting means specifies a first mode in which sorting is based on a denomination of bills and a second mode in which sorting is based on a fitness criteria of bills which represents whether the bill is fit for reuse or unfit for reuse.

7. An apparatus according to claim 6, which further includes a common numerical key for specifying the denomination and the quantity of said bills to be sorted.

8. An apparatus according to claim 7, in which said judging means has a variable threshold level for determining the state of sheet damage, said threshold level being held fixed during the sorting operation.

9. An apparatus according to claim 7, in which said common numerical key sets one of the modes of denomination and quantity of said bills, said numerical key setting said quantity mode when actuated before a mode is set by said mode setting means and said numerical key setting said denomination mode when actuated after a mode is set by said mode setting means.

10. An apparatus according to claim 1, in which said quantity inputting means further includes, a means for specifying a quantity of sheets stacked in a first stacker and a second stacker of said plurality of stackers, and when, during operation, the quantity of stacked bills equals said specified quantity, the sorting operation is interrupted to permit removal of said sheets from the stacker having said quantity of bills equal to said specified quantity; and said apparatus further including a means for generation of an alarm signal indicating that said quantity of stacked bills equals said specified quantity.

11. An apparatus according to claim 10, which further includes display means for displaying information including said specified quantity which exists before the start of the sorting operation, and displaying the quantity of sheets stacked in each of said stackers during the sorting operation.

12. An apparatus according to claim 10, which further includes means for accumulating data including quantities of sheets removed from said stackers, and a means for printing the quantity of said accumulation.

13. An apparatus according to claim 10, further including a means for restarting said transporting means by a restart command and said mode setting means initiates an alarm signal when said mode of sorting and said specified quantity at the time of restarting said transporting means are altered from the specified mode and quantity that existed before the restart.

14. An apparatus for sorting a mixture of different kinds of sheets fed to the apparatus one by one and stacking a predetermined quantity of sorted sheets at least one comprising:

a plurality of stacking means for stacking sheets;

mode setting means for setting one of a plurality of modes of sorting which indicates the type of sheet to be sorted and stacked into a specified stacking means of said plurality of stacking means;

means for inputting a quantity of sheets to be sorted in each stacking means for each mode of sorting specified by said mode setting means, said quantity of sheets being predetermined;

memory means having memory sections each of which stores information relating to the quantity of sheets to be sorted in each stacking means for each of said modes and in which a predetermined number is initially preset, the quantity of sheets to be sorted in each stacking means being variable by said inputting means;

means for judging the type of sheets fed to the apparatus;

transporting means for transporting said judged sheets to at least one of said stacking means according to the mode of sorting specified by said mode setting means; and means for interrupting said transporting means including means for counting the quantity of sheets stacked in said stacking means and stopping the operation of said transporting means when the quantity of sheets stacked in a specified stacking means equals the predetermined quantity to be sorted and stacked.

15. An apparatus for sorting a mixture of different kinds of sheets fed onto the apparatus one by one and stacking the sorted sheets, comprising:

feeding means for feeding a mixture of different kinds of sheets one by one;

a plurality of stacking means for stacking said sheets fed by said feeding means;

means for judging a type of sheets in said mixture of different kinds of sheets fed by said feeding means;

mode setting means for specifying one of a plurality of modes of sorting said judged type of sheets in said mixture of different kinds of sheets the mode indicating what type of sheets to be sorted and stacked into which of said stacking means;

means for inputting a specified quantity of sheets to be stacked into each of said stacking means for each of said modes of sorting specified by said mode setting means, the quantity of sheets to be sorted in each stacking means being variable by said inputting means;

memory means having memory sections each of which stores information relating to the specified quantity of sheets to be stacked into each of said stacking means corresponding to each of said modes; and means for transporting the judged sheets to at least one of said stacking means according to the mode for sorting set by said mode setting means, the operation of said transporting means being interrupted when said specified quantity of sheets are stacked into at least one of said stacking means.

16. An apparatus according to claim 15, in which each of said memory section stores a preset predetermined number relating to the specified quantity of sheets to be stacked into each of said stacking means for each of said modes, the preset predetermined number being different for each of said modes.

17. An apparatus according to claim 16, in which said mode setting means selects a count mode in which banknotes are sorted in accordance with a denomination and a fit/unfit mode in which banknotes are sorted in accordance with a judgement aas to whether the banknote is fit or unfit; and in which said preset predetermined number for said count mode is larger than that for the fit/unfit mode.

18. An apparatus according to claim 17, in which said mode setting means further selects said count mode, a facing mode whether the banknotes are sorted in accordance with a judgement as to whether the banknote is face-up or face-down, and said fit/unfit mode; and in which said preset predetermined number for said facing mode is larger than that for the fit/unfit mode.

19. An apparatus according to claim 15, in which said preset predetermined number stored in said memory sections is varied in accordance with the quantity of sheets input by said inputting means.

* * * * *